US010900176B2

(12) United States Patent
Miller, IV et al.

(10) Patent No.: US 10,900,176 B2
(45) Date of Patent: Jan. 26, 2021

(54) SOFT TISSUE PRODUCED USING A STRUCTURED FABRIC AND ENERGY EFFICIENT PRESSING

(71) Applicant: First Quality Tissue, LLC, Great Neck, NY (US)

(72) Inventors: Byrd Tyler Miller, IV, Easley, SC (US); Justin S. Pence, Anderson, SC (US); James E. Sealey, Belton, SC (US)

(73) Assignee: FIRST QUALITY TISSUE, LLC, Great Neck, NY (US)

( * ) Notice: Subject to any disclaimer, the term of this patent is extended or adjusted under 35 U.S.C. 154(b) by 0 days.

(21) Appl. No.: 16/353,160

(22) Filed: Mar. 14, 2019

(65) Prior Publication Data

US 2019/0316298 A1 Oct. 17, 2019

Related U.S. Application Data

(63) Continuation of application No. 14/951,121, filed on Nov. 24, 2015, now Pat. No. 10,273,635.
(Continued)

(51) Int. Cl.
*D21H 27/00* (2006.01)
*D21H 21/18* (2006.01)
(Continued)

(52) U.S. Cl.
CPC ..... *D21H 27/005* (2013.01); *D21H 5/14* (2013.01); *D21H 11/12* (2013.01); *D21H 17/28* (2013.01); *D21H 17/375* (2013.01); *D21H 21/14* (2013.01); *D21H 21/18* (2013.01); *D21H 21/20* (2013.01); *D21H 21/22* (2013.01); *D21H 21/24* (2013.01); *D21H 21/28* (2013.01); *D21H 27/002* (2013.01); *D21H 27/30* (2013.01); *D21H 27/40* (2013.01)

(58) Field of Classification Search
None
See application file for complete search history.

(56) References Cited

U.S. PATENT DOCUMENTS 2,874,618 A * 2/1959 Yang ..... D21H 27/02 162/113
2,919,467 A 1/1960 Mercer
(Continued)

FOREIGN PATENT DOCUMENTS

CA 2168894 A1 8/1997
CA 2795139 A1 10/2011
(Continued)

OTHER PUBLICATIONS

Definition of "bulk", Smook, Gary A., Handbook of Pulp and Paper Terminology, Angus Wilde Publications, 1990, p. 212. (Year: 1990).*
(Continued)

*Primary Examiner* — Dennis R Cordray
(74) *Attorney, Agent, or Firm* — Amster, Rothstein & Ebenstein LLP

(57) ABSTRACT

A structured tissue product produced using a structured or imprinting fabric and a press roll. The tissue product has at least two plies, and has a crumple resistance of less than 30 grams force and an average peak to valley depth of at least 65 microns.

38 Claims, 5 Drawing Sheets

Related U.S. Application Data

(60) Provisional application No. 62/083,735, filed on Nov. 24, 2014.

(51) Int. Cl.

| | |
|---|---|
| ***D21H 21/24*** | (2006.01) |
| ***D21H 17/37*** | (2006.01) |
| ***D21H 17/28*** | (2006.01) |
| ***D21H 21/14*** | (2006.01) |
| ***D21H 21/20*** | (2006.01) |
| ***D21H 11/00*** | (2006.01) |
| ***D21H 11/12*** | (2006.01) |
| ***D21H 21/28*** | (2006.01) |
| ***D21H 21/22*** | (2006.01) |
| ***D21H 27/30*** | (2006.01) |
| ***D21H 27/40*** | (2006.01) |

(56) References Cited

U.S. PATENT DOCUMENTS 2,926,154 A 2/1960 Keim
3,026,231 A 3/1962 Chavannes
3,049,469 A 8/1962 Davison
3,058,873 A 10/1962 Keim et al.
3,066,066 A 11/1962 Keim et al.
3,097,994 A 7/1963 Dickens et al.
3,125,552 A 3/1964 Loshaek et al.
3,143,150 A 8/1964 Buchanan
3,186,900 A 6/1965 De Young
3,197,427 A 7/1965 Schmatz
3,224,986 A 12/1965 Butler et al.
3,224,990 A 12/1965 Babcock
3,227,615 A 1/1966 Korden
3,227,671 A 1/1966 Keim
3,239,491 A 3/1966 Tsou et al.
3,240,664 A 3/1966 Earle, Jr.
3,240,761 A 3/1966 Keim et al.
3,248,280 A 4/1966 Hyland, Jr.
3,250,664 A 5/1966 Conte et al.
3,252,181 A 5/1966 Hureau
3,301,746 A 1/1967 Sanford et al.
3,311,594 A 3/1967 Earle, Jr.
3,329,657 A 7/1967 Strazdins et al.
3,332,834 A 7/1967 Reynolds, Jr.
3,332,901 A 7/1967 Keim
3,352,833 A 11/1967 Earle, Jr.
3,384,692 A 5/1968 Galt et al.
3,414,459 A 12/1968 Wells
3,442,754 A 5/1969 Espy
3,459,697 A 8/1969 Goldberg et al.
3,473,576 A 10/1969 Amneus
3,483,077 A 12/1969 Aldrich
3,545,165 A 12/1970 Greenwell
3,556,932 A 1/1971 Coscia et al.
3,573,164 A 3/1971 Friedberg et al.
3,609,126 A 9/1971 Asao et al.
3,666,609 A 5/1972 Kalwaites et al.
3,672,949 A 6/1972 Brown
3,672,950 A 6/1972 Murphy et al.
3,773,290 A 11/1973 Mowery
3,778,339 A 12/1973 Williams et al.
3,813,362 A 5/1974 Coscia et al.
3,855,158 A 12/1974 Petrovich et al.
3,877,510 A 4/1975 Tegtmeier et al.
3,905,863 A 9/1975 Ayers
3,911,173 A 10/1975 Sprague, Jr.
3,974,025 A 8/1976 Ayers
3,994,771 A 11/1976 Morgan, Jr. et al.
3,998,690 A 12/1976 Lyness et al.
4,038,008 A 7/1977 Larsen
4,075,382 A 2/1978 Chapman et al.
4,088,528 A 5/1978 Berger et al.
4,098,632 A 7/1978 Sprague, Jr.
4,102,737 A 7/1978 Morton
4,129,528 A 12/1978 Petrovich et al.
4,147,586 A 4/1979 Petrovich et al.
4,184,519 A 1/1980 McDonald et al.
4,190,692 A 2/1980 Larsen
4,191,609 A 3/1980 Trokhan
4,252,761 A 2/1981 Schoggen et al.
4,320,162 A 3/1982 Schulz
4,331,510 A 5/1982 Wells
4,382,987 A 5/1983 Smart
4,440,597 A 4/1984 Wells et al.
4,501,862 A 2/1985 Keim
4,507,351 A 3/1985 Johnson et al.
4,514,345 A 4/1985 Johnson et al.
4,515,657 A 5/1985 Maslanka
4,528,239 A 7/1985 Trokhan
4,529,480 A 7/1985 Trokhan
4,537,657 A 8/1985 Keim
4,545,857 A 10/1985 Wells
4,637,859 A 1/1987 Trokhan
4,678,590 A 7/1987 Nakamura et al.
4,714,736 A 12/1987 Juhl et al.
4,770,920 A 9/1988 Larsonneur
4,780,357 A 10/1988 Akao
4,808,467 A 2/1989 Suskind et al.
4,836,894 A 6/1989 Chance et al.
4,849,054 A 7/1989 Klowak
4,885,202 A 12/1989 Lloyd et al.
4,891,249 A 1/1990 McIntyre
4,909,284 A 3/1990 Kositake
4,949,668 A 8/1990 Heindel et al.
4,949,688 A 8/1990 Bayless
4,983,256 A 1/1991 Combette et al.
4,996,091 A 2/1991 McIntyre
5,059,282 A 10/1991 Ampulski et al.
5,143,776 A 9/1992 Givens
5,149,401 A 9/1992 Langevin et al.
5,152,874 A 10/1992 Keller
5,211,813 A 5/1993 Sawley et al.
5,239,047 A 8/1993 Devore et al.
5,279,098 A 1/1994 Fukuda
5,281,306 A 1/1994 Kakiuchi et al.
5,334,289 A 8/1994 Trokhan et al.
5,347,795 A 9/1994 Fukuda
5,397,435 A 3/1995 Ostendorf et al.
5,399,412 A 3/1995 Sudall et al.
5,405,501 A 4/1995 Phan et al.
5,409,572 A 4/1995 Kershaw et al.
5,429,686 A 7/1995 Chiu et al.
5,439,559 A 8/1995 Crouse
5,447,012 A 9/1995 Kovacs et al.
5,470,436 A 11/1995 Wagle et al.
5,487,313 A 1/1996 Johnson
5,509,913 A 4/1996 Yeo
5,510,002 A 4/1996 Hermans et al.
5,529,665 A 6/1996 Kaun
5,581,906 A 12/1996 Ensign et al.
5,591,147 A 1/1997 Couture-Dorschner et al.
5,607,551 A 3/1997 Farrington, Jr. et al.
5,611,890 A 3/1997 Vinson et al.
5,628,876 A 5/1997 Ayers et al.
5,635,028 A 6/1997 Vinson et al.
5,649,916 A 7/1997 DiPalma et al.
5,671,897 A 9/1997 Ogg et al.
5,672,248 A 9/1997 Wendt et al.
5,679,222 A 10/1997 Rasch et al.
5,685,428 A 11/1997 Herbers et al.
5,728,268 A 3/1998 Weisman et al.
5,746,887 A 5/1998 Wendt et al.
5,753,067 A 5/1998 Fukuda et al.
5,772,845 A 6/1998 Farrington, Jr. et al.
5,806,569 A 9/1998 Gulya et al.
5,827,384 A 10/1998 Canfield et al.
5,832,962 A 11/1998 Kaufman et al.
5,846,380 A 12/1998 Van Phan et al.
5,855,738 A 1/1999 Weisman et al.
5,858,554 A 1/1999 Neal et al.
5,865,396 A 2/1999 Ogg et al.
5,865,950 A 2/1999 Vinson et al.
5,893,965 A 4/1999 Trokhan et al.

(56) References Cited

U.S. PATENT DOCUMENTS

| | | | |
|---|---|---|---|
| 5,913,765 | A | 6/1999 | Burgess et al. |
| 5,942,085 | A | 8/1999 | Neal et al. |
| 5,944,954 | A | 8/1999 | Vinson et al. |
| 5,948,210 | A | 9/1999 | Huston |
| 5,980,691 | A | 11/1999 | Weisman et al. |
| 6,036,139 | A | 3/2000 | Ogg |
| 6,039,838 | A | 3/2000 | Kaufman et al. |
| 6,048,938 | A | 4/2000 | Neal et al. |
| 6,060,149 | A | 5/2000 | Nissing et al. |
| 6,106,670 | A | 8/2000 | Weisman et al. |
| 6,149,769 | A | 11/2000 | Mohammadi et al. |
| 6,162,327 | A | 12/2000 | Batra |
| 6,162,329 | A | 12/2000 | Vinson et al. |
| 6,187,138 | B1 | 2/2001 | Neal et al. |
| 6,200,419 | B1 | 3/2001 | Phan |
| 6,203,667 | B1 | 3/2001 | Huhtelin |
| 6,207,734 | B1 | 3/2001 | Vinson et al. |
| 6,231,723 | B1 | 5/2001 | Kanitz et al. |
| 6,287,426 | B1 | 9/2001 | Edwards et al. |
| 6,303,233 | B1 | 10/2001 | Amon et al. |
| 6,319,362 | B1 | 11/2001 | Huhtelin et al. |
| 6,344,111 | B1 | 2/2002 | Wilhelm |
| 6,420,013 | B1 | 7/2002 | Vinson et al. |
| 6,420,100 | B1 | 7/2002 | Trokhan et al. |
| 6,423,184 | B2 | 7/2002 | Vahatalo et al. |
| 6,458,246 | B1 | 10/2002 | Kanitz et al. |
| 6,464,831 | B1 | 10/2002 | Trokhan et al. |
| 6,473,670 | B1 | 10/2002 | Huhtelin |
| 6,521,089 | B1 | 2/2003 | Griech et al. |
| 6,537,407 | B1 | 3/2003 | Law et al. |
| 6,547,928 | B2 | 4/2003 | Barnholtz et al. |
| 6,551,453 | B2 | 4/2003 | Weisman et al. |
| 6,551,691 | B1 | 4/2003 | Hoeft et al. |
| 6,572,722 | B1 | 6/2003 | Pratt |
| 6,579,416 | B1 | 6/2003 | Vinson et al. |
| 6,602,454 | B2 | 8/2003 | McGuire et al. |
| 6,607,637 | B1 | 8/2003 | Vinson et al. |
| 6,610,173 | B1 | 8/2003 | Lindsay et al. |
| 6,613,194 | B2 | 9/2003 | Kanitz et al. |
| 6,660,362 | B1 | 9/2003 | Lindsay et al. |
| 6,673,202 | B2 | 1/2004 | Burazin |
| 6,701,637 | B2 | 5/2004 | Lindsay et al. |
| 6,755,939 | B2 | 6/2004 | Vinson et al. |
| 6,773,647 | B2 | 8/2004 | McGuire et al. |
| 6,797,117 | B1 | 9/2004 | McKay et al. |
| 6,808,599 | B2 | 10/2004 | Burazin |
| 3,821,386 | A1 | 11/2004 | Weisman et al. |
| 6,821,391 | B2 | 11/2004 | Scherb et al. |
| 6,827,818 | B2 | 12/2004 | Farrington, Jr. et al. |
| 6,863,777 | B2 | 3/2005 | Kanitz et al. |
| 6,896,767 | B2 | 5/2005 | Wilhelm |
| 6,939,443 | B2 | 9/2005 | Ryan et al. |
| 6,998,017 | B2 | 2/2006 | Lindsay et al. |
| 6,998,024 | B2 | 2/2006 | Burazin |
| 7,005,043 | B2 | 2/2006 | Toney et al. |
| 7,014,735 | B2 | 3/2006 | Kramer et al. |
| 7,105,465 | B2 | 9/2006 | Patel et al. |
| 7,155,876 | B2 | 1/2007 | VanderTuin et al. |
| 7,157,389 | B2 | 1/2007 | Branham et al. |
| 7,182,837 | B2 | 2/2007 | Chen |
| 7,194,788 | B2 | 3/2007 | Clark et al. |
| 7,235,156 | B2 | 6/2007 | Baggot |
| 7,269,929 | B2 | 9/2007 | VanderTuin et al. |
| 7,294,230 | B2 | 11/2007 | Flugge-Berendes et al. |
| 7,311,853 | B2 | 12/2007 | Vinson et al. |
| 7,328,550 | B2 | 2/2008 | Floding et al. |
| 7,339,378 | B2 | 3/2008 | Han et al. |
| 7,351,307 | B2 | 4/2008 | Scherb et al. |
| 7,387,706 | B2 | 6/2008 | Herman et al. |
| 7,399,378 | B2 | 7/2008 | Edwards et al. |
| 7,419,569 | B2 | 9/2008 | Hermans |
| 7,427,434 | B2 | 9/2008 | Busam |
| 7,431,801 | B2 | 10/2008 | Conn et al. |
| 7,432,309 | B2 | 10/2008 | Vinson |
| 7,442,278 | B2 | 10/2008 | Murray et al. |
| 7,452,447 | B2 | 11/2008 | Duan et al. |
| 7,476,293 | B2 | 1/2009 | Herman et al. |
| 7,494,563 | B2 | 2/2009 | Edwards et al. |
| 7,510,631 | B2 | 3/2009 | Scherb et al. |
| 7,513,975 | B2 | 4/2009 | Burma |
| 7,563,344 | B2 | 7/2009 | Beuther |
| 7,582,187 | B2 | 9/2009 | Scherb et al. |
| 7,611,607 | B2 | 11/2009 | Mullally et al. |
| 7,622,020 | B2 | 11/2009 | Awofeso |
| 7,662,462 | B2 | 2/2010 | Noda |
| 7,670,678 | B2 | 3/2010 | Phan |
| 7,683,126 | B2 | 3/2010 | Neal et al. |
| 7,686,923 | B2 | 3/2010 | Scherb et al. |
| 7,687,140 | B2 | 3/2010 | Manifold et al. |
| 7,691,230 | B2 | 4/2010 | Scherb et al. |
| 7,744,722 | B1 | 6/2010 | Tucker et al. |
| 7,744,726 | B2 | 6/2010 | Scherb et al. |
| 7,799,382 | B2 | 9/2010 | Payne et al. |
| 7,811,418 | B2 | 10/2010 | Klerelid et al. |
| 7,815,978 | B2 | 10/2010 | Davenport et al. |
| 7,823,366 | B2 | 11/2010 | Schoeneck |
| 7,842,163 | B2 | 11/2010 | Nickel |
| 7,867,361 | B2 | 1/2011 | Salaam et al. |
| 7,871,692 | B2 | 1/2011 | Morin et al. |
| 7,887,673 | B2 | 2/2011 | Andersson et al. |
| 7,905,989 | B2 | 3/2011 | Scherb et al. |
| 7,914,866 | B2 | 3/2011 | Shannon et al. |
| 7,931,781 | B2 | 4/2011 | Scherb et al. |
| 7,951,269 | B2 | 5/2011 | Herman et al. |
| 7,955,549 | B2 | 6/2011 | Noda |
| 7,959,764 | B2 | 6/2011 | Ringer et al. |
| 7,972,474 | B2 | 7/2011 | Underhill |
| 7,972,475 | B2 | 7/2011 | Chan et al. |
| 7,989,058 | B2 | 8/2011 | Manifold et al. |
| 8,034,463 | B2 | 10/2011 | Leimbach et al. |
| 8,051,629 | B2 | 11/2011 | Pazdernik et al. |
| 8,075,739 | B2 | 12/2011 | Scherb et al. |
| 8,092,652 | B2 | 1/2012 | Scherb et al. |
| 8,118,979 | B2 | 2/2012 | Herman et al. |
| 8,147,649 | B1 | 4/2012 | Tucker et al. |
| 8,152,959 | B2 | 4/2012 | Elony et al. |
| 8,196,314 | B2 | 6/2012 | Munch |
| 8,216,427 | B2 | 7/2012 | Klerelid et al. |
| 8,236,135 | B2 | 8/2012 | Prodoehl et al. |
| 8,303,773 | B2 | 11/2012 | Scherb et al. |
| 8,382,956 | B2 | 2/2013 | Boechat et al. |
| 8,402,673 | B2 | 3/2013 | Da Silva et al. |
| 8,409,404 | B2 | 4/2013 | Harper et al. |
| 8,435,384 | B2 | 5/2013 | Da Silva et al. |
| 8,440,055 | B2 | 5/2013 | Scherb et al. |
| 8,445,032 | B2 | 5/2013 | Topolkaraev et al. |
| 8,454,800 | B2 | 6/2013 | Mourad et al. |
| 8,470,133 | B2 | 6/2013 | Cunnane et al. |
| 8,506,756 | B2 | 8/2013 | Denis et al. |
| 8,544,184 | B2 | 10/2013 | Da Silva et al. |
| 8,574,211 | B2 | 11/2013 | Morita |
| 8,580,083 | B2 | 11/2013 | Boechat et al. |
| 8,728,277 | B2 | 5/2014 | Boechat et al. |
| 8,758,569 | B2 | 6/2014 | Aberg et al. |
| 8,771,466 | B2 | 7/2014 | Denis et al. |
| 8,801,903 | B2 | 8/2014 | Mourad et al. |
| 8,815,057 | B2 | 8/2014 | Eberhardt et al. |
| 8,822,009 | B2 | 9/2014 | Riviere et al. |
| 8,968,517 | B2 | 3/2015 | Ramaratnam et al. |
| 8,980,062 | B2 | 3/2015 | Karlsson et al. |
| 9,005,710 | B2 | 4/2015 | Jones et al. |
| D734,617 | S | 7/2015 | Seitzinger et al. |
| 9,095,477 | B2 | 8/2015 | Yamaguchi |
| D738,633 | S | 9/2015 | Seitzinger et al. |
| 9,382,666 | B2 | 7/2016 | Ramaratnam et al. |
| 9,506,203 | B2 | 11/2016 | Ramaratnam et al. |
| 9,580,872 | B2 | 2/2017 | Ramaratnam et al. |
| 9,702,089 | B2 | 7/2017 | Ramaratnam et al. |
| 9,702,090 | B2 | 7/2017 | Ramaratnam et al. |
| 9,719,213 | B2 | 8/2017 | Miller, IV et al. |
| 9,725,853 | B2 | 8/2017 | Ramaratnam et al. |
| 2001/0018068 | A1 | 8/2001 | Lorenz et al. |
| 2002/0028230 | A1 | 3/2002 | Eichhorn et al. |
| 2002/0060049 | A1 | 5/2002 | Kanitz et al. |

(56) References Cited

U.S. PATENT DOCUMENTS

| | | | |
|---|---|---|---|
| 2002/0061386 | A1 | 5/2002 | Carson et al. |
| 2002/0098317 | A1 | 7/2002 | Jaschinski et al. |
| 2002/0110655 | A1 | 8/2002 | Seth |
| 2002/0115194 | A1 | 8/2002 | Lange et al. |
| 2002/0125606 | A1 | 9/2002 | McGuire et al. |
| 2003/0024674 | A1 | 2/2003 | Kanitz et al. |
| 2003/0056911 | A1 | 3/2003 | Hermans et al. |
| 2003/0056917 | A1 | 3/2003 | Jimenez |
| 2003/0070781 | A1 | 4/2003 | Hermans et al. |
| 2003/0114071 | A1 | 6/2003 | Everhart et al. |
| 2003/0159401 | A1 | 8/2003 | Sorensson et al. |
| 2003/0188843 | A1 | 10/2003 | Kanitz et al. |
| 2003/0218274 | A1 | 11/2003 | Boutilier et al. |
| 2004/0118531 | A1 | 6/2004 | Shannon et al. |
| 2004/0123963 | A1 | 7/2004 | Chen et al. |
| 2004/0126601 | A1 | 7/2004 | Kramer et al. |
| 2004/0126710 | A1 | 7/2004 | Hill et al. |
| 2004/0168784 | A1 | 9/2004 | Duan et al. |
| 2004/0173333 | A1 | 9/2004 | Hermans et al. |
| 2004/0234804 | A1 | 11/2004 | Liu et al. |
| 2005/0016704 | A1 | 1/2005 | Huhtelin |
| 2005/0069679 | A1 | 3/2005 | Stelljes et al. |
| 2005/0069680 | A1 | 3/2005 | Stelljes et al. |
| 2005/0098281 | A1 | 5/2005 | Schulz et al. |
| 2005/0112115 | A1 | 5/2005 | Khan |
| 2005/0123726 | A1 | 6/2005 | Broering et al. |
| 2005/0130536 | A1 | 6/2005 | Siebers et al. |
| 2005/0136222 | A1 | 6/2005 | Hada et al. |
| 2005/0148257 | A1 | 7/2005 | Hermans et al. |
| 2005/0150626 | A1 | 7/2005 | Kanitz et al. |
| 2005/0166551 | A1 | 8/2005 | Keane et al. |
| 2005/0241786 | A1 | 11/2005 | Edwards et al. |
| 2005/0241788 | A1 | 11/2005 | Baggot et al. |
| 2005/0252626 | A1 | 11/2005 | Chen et al. |
| 2005/0280184 | A1 | 12/2005 | Sayers et al. |
| 2005/0287340 | A1 | 12/2005 | Morelli et al. |
| 2006/0005916 | A1 | 1/2006 | Stelljes et al. |
| 2006/0013998 | A1 | 1/2006 | Stelljes et al. |
| 2006/0019567 | A1 | 1/2006 | Sayers |
| 2006/0083899 | A1 | 4/2006 | Burazin et al. |
| 2006/0093788 | A1 | 5/2006 | Behm et al. |
| 2006/0113049 | A1 | 6/2006 | Knobloch et al. |
| 2006/0130986 | A1 | 6/2006 | Flugge-Berendes et al. |
| 2006/0194022 | A1 | 8/2006 | Boutilier et al. |
| 2006/0269706 | A1 | 11/2006 | Shannon et al. |
| 2007/0020315 | A1 | 1/2007 | Shannon et al. |
| 2007/0131366 | A1 | 6/2007 | Underhill et al. |
| 2007/0137813 | A1 | 6/2007 | Nickel et al. |
| 2007/0137814 | A1 | 6/2007 | Gao |
| 2007/0170610 | A1 | 7/2007 | Payne et al. |
| 2007/0240842 | A1 | 10/2007 | Scherb et al. |
| 2007/0251659 | A1 | 11/2007 | Fernandes et al. |
| 2007/0251660 | A1 | 11/2007 | Walkenhaus et al. |
| 2007/0267157 | A1 | 11/2007 | Kanitz et al. |
| 2007/0272381 | A1 | 11/2007 | Elony et al. |
| 2007/0275866 | A1 | 11/2007 | Dykstra |
| 2007/0298221 | A1 | 12/2007 | Vinson |
| 2008/0035289 | A1 | 2/2008 | Edwards et al. |
| 2008/0076695 | A1 | 3/2008 | Uitenbroek et al. |
| 2008/0156450 | A1 | 7/2008 | Klerelid et al. |
| 2008/0199655 | A1 | 8/2008 | Monnerie et al. |
| 2008/0245498 | A1 | 10/2008 | Ostendorf et al. |
| 2008/0302493 | A1 | 12/2008 | Boatman et al. |
| 2008/0308247 | A1 | 12/2008 | Ringer et al. |
| 2009/0020248 | A1 | 1/2009 | Sumnicht et al. |
| 2009/0056892 | A1 | 3/2009 | Rekoske |
| 2009/0061709 | A1 | 3/2009 | Nakai et al. |
| 2009/0205797 | A1 | 8/2009 | Fernandes et al. |
| 2009/0218056 | A1 | 9/2009 | Manifold et al. |
| 2010/0065234 | A1 | 3/2010 | Klerelid et al. |
| 2010/0119779 | A1 | 5/2010 | Ostendorf et al. |
| 2010/0224338 | A1 | 9/2010 | Harper et al. |
| 2010/0230064 | A1 | 9/2010 | Eagles et al. |
| 2010/0236034 | A1 | 9/2010 | Eagles et al. |
| 2010/0239825 | A1 | 9/2010 | Sheehan et al. |
| 2010/0272965 | A1 | 10/2010 | Schinkoreit et al. |
| 2011/0027545 | A1 | 2/2011 | Harlacher et al. |
| 2011/0180223 | A1 | 7/2011 | Klerelid et al. |
| 2011/0189435 | A1 | 8/2011 | Manifold et al. |
| 2011/0189442 | A1 | 8/2011 | Manifold et al. |
| 2011/0206913 | A1 | 8/2011 | Manifold et al. |
| 2011/0223381 | A1 | 9/2011 | Sauter et al. |
| 2011/0253329 | A1 | 10/2011 | Manifold et al. |
| 2011/0265967 | A1 | 11/2011 | Van Phan |
| 2011/0303379 | A1 | 12/2011 | Boechat et al. |
| 2012/0144611 | A1 | 6/2012 | Baker et al. |
| 2012/0152475 | A1 | 6/2012 | Edwards et al. |
| 2012/0177888 | A1 | 7/2012 | Escafere et al. |
| 2012/0244241 | A1 | 9/2012 | McNeil |
| 2012/0267063 | A1 | 10/2012 | Klerelid et al. |
| 2012/0297560 | A1 | 11/2012 | Zwick et al. |
| 2013/0008135 | A1 | 1/2013 | Moore et al. |
| 2013/0029105 | A1 | 1/2013 | Miller et al. |
| 2013/0029106 | A1 | 1/2013 | Lee et al. |
| 2013/0133851 | A1 | 5/2013 | Boechat et al. |
| 2013/0150817 | A1 | 6/2013 | Kainth et al. |
| 2013/0160960 | A1 | 6/2013 | Hermans et al. |
| 2013/0209749 | A1 | 8/2013 | Myangiro et al. |
| 2013/0248129 | A1 | 9/2013 | Manifold et al. |
| 2013/0327487 | A1 | 12/2013 | Espinosa et al. |
| 2014/0004307 | A1 | 1/2014 | Sheehan |
| 2014/0041820 | A1 | 2/2014 | Ramaratnam et al. |
| 2014/0041822 | A1 | 2/2014 | Boechat et al. |
| 2014/0050890 | A1 | 2/2014 | Zwick et al. |
| 2014/0053994 | A1 | 2/2014 | Manifold et al. |
| 2014/0096924 | A1 | 4/2014 | Rekoske et al. |
| 2014/0182798 | A1 | 7/2014 | Polat et al. |
| 2014/0242320 | A1 | 8/2014 | McNeil et al. |
| 2014/0272269 | A1 | 9/2014 | Hansen |
| 2014/0272747 | A1 | 9/2014 | Ciurkot |
| 2014/0284237 | A1 | 9/2014 | Gosset |
| 2014/0360519 | A1 | 12/2014 | George et al. |
| 2015/0059995 | A1 | 3/2015 | Ramaratnam et al. |
| 2015/0102526 | A1 | 4/2015 | Ward et al. |
| 2015/0129145 | A1 | 5/2015 | Chou et al. |
| 2015/0211179 | A1 | 7/2015 | Alias et al. |
| 2015/0241788 | A1 | 8/2015 | Yamaguchi |
| 2015/0330029 | A1 | 11/2015 | Ramaratnam et al. |
| 2016/0060811 | A1 | 3/2016 | Riding et al. |
| 2016/0090692 | A1 | 3/2016 | Eagles et al. |
| 2016/0090693 | A1 | 3/2016 | Eagles et al. |
| 2016/0130762 | A1 | 5/2016 | Ramaratnam et al. |
| 2016/0159007 | A1 | 6/2016 | Miller, IV et al. |
| 2016/0160448 | A1 | 6/2016 | Miller, IV et al. |
| 2016/0185041 | A1 | 6/2016 | Topolkaraev et al. |
| 2016/0185050 | A1 | 6/2016 | Topolkaraev et al. |
| 2016/0273168 | A1 | 9/2016 | Ramaratnam et al. |
| 2016/0273169 | A1 | 9/2016 | Ramaratnam et al. |
| 2016/0289897 | A1 | 10/2016 | Ramaratnam et al. |
| 2016/0289898 | A1 | 10/2016 | Ramaratnam et al. |
| 2017/0044717 | A1 | 2/2017 | Quigley |
| 2017/0101741 | A1 | 4/2017 | Sealey et al. |
| 2017/0167082 | A1 | 6/2017 | Ramaratnam et al. |
| 2017/0226698 | A1 | 8/2017 | LeBrun et al. |
| 2017/0233946 | A1 | 8/2017 | Sealey et al. |
| 2017/0253422 | A1 | 9/2017 | Anklam et al. |
| 2017/0268176 | A1 | 9/2017 | Ramaratnam et al. |

FOREIGN PATENT DOCUMENTS

| | | | |
|---|---|---|---|
| CN | 1138356 | A | 12/1996 |
| CN | 1207149 | A | 2/1999 |
| CN | 1244899 | A | 2/2000 |
| CN | 1268559 | A | 10/2000 |
| CN | 1377405 | A | 10/2002 |
| CN | 2728254 | Y | 9/2005 |
| DE | 4242539 | A1 | 8/1993 |
| EP | 0097036 | A2 | 12/1983 |
| EP | 0979895 | A1 | 2/2000 |
| EP | 1911574 | A1 | 1/2007 |
| EP | 1339915 | B1 | 7/2007 |
| EP | 2123826 | A2 | 5/2009 |
| GB | 946093 | A | 1/1964 |
| JP | 2013208298 | A | 10/2013 |

(56) References Cited

FOREIGN PATENT DOCUMENTS

| | | | |
|---|---|---|---|
| JP | 2014213138 | A | 11/2014 |
| WO | 96/06223 | A1 | 2/1996 |
| WO | 200382550 | A2 | 10/2003 |
| WO | 200445834 | A1 | 6/2004 |
| WO | 2007070145 | A1 | 6/2007 |
| WO | 2008019702 | A1 | 2/2008 |
| WO | 200906709 | A1 | 1/2009 |
| WO | 2009061079 | A1 | 5/2009 |
| WO | 2009067079 | A1 | 5/2009 |
| WO | 2011028823 | A1 | 3/2011 |
| WO | 2012003360 | A2 | 1/2012 |
| WO | 2013024297 | A1 | 2/2013 |
| WO | 2013136471 | A1 | 9/2013 |
| WO | 2014/022848 | A1 | 2/2014 |
| WO | 201500755 | A1 | 1/2015 |
| WO | 2015/176063 | A1 | 11/2015 |
| WO | 2016/077594 | A1 | 5/2016 |
| WO | 2016/086019 | A1 | 6/2016 |
| WO | 2016/090242 | A1 | 6/2016 |
| WO | 2016/090364 | A1 | 6/2016 |
| WO | 2016085704 | A1 | 6/2016 |
| WO | 2017066465 | A1 | 4/2017 |
| WO | 2017066656 | A1 | 4/2017 |
| WO | 2017139786 | A1 | 8/2017 |

OTHER PUBLICATIONS

International Preliminary Report on Patentability of PCT/US2013/053593 dated Feb. 3, 2015.
Supplementary European Search Report of EP 13 82 6461 dated Apr. 1, 2016.
International Search Report for PCT/US16/56871 dated Jan. 12, 2017.
Written Opinion of International Searching Authority for PCT/US16/56871 dated Jan. 12, 2017.
International Search Report for PCT/US2016/057163 dated Dec. 23, 2016.
Written Opinion of International Searching Authority for PCT/US2016/057163 dated Dec. 23, 2016.
International Search Report for PCT/US2017/029890 dated Jul. 14, 2017.
Written Opinion of International Searching Authority for PCT/US2017/029890 dated Jul. 14, 2017.
International Search Report for PCT/US2017/032746 dated Aug. 7, 2017.
Written Opinion of International Searching Authority for PCT/US2017/032746 dated Aug. 7, 2017.
International Search Report for PCT/US17/17705 dated Jun. 9, 2017.
Written Opinion of International Searching Authority for PCT/US17/17705 dated Jun. 9, 2017.
Written Opinion of International Searching Authority for PCT/US15/60398 dated Jan. 29, 2016.
International Search Report for PCT/US15/63986 dated Mar. 29, 2016.
Written Opinion of International Searching Authority for PCT/US15/63986 dated Mar. 29, 2016.
International Search Report for PCT/US15/64284 dated Feb. 11, 2016.
Written Opinion of International Searching Authority for PCT/US15/64284 dated Feb. 11, 2016.
International Search Report for PCT/US15/60398 dated Jan. 29, 2016.
Written Opinion of International Searching Authority for PCT/US15/31411 dated Aug. 13, 2015.
International Search Report for PCT/US15/31411 dated Aug. 13, 2015.
International Search Report of PCT/US13/53593 dated Dec. 20, 2013.
Written Opinion of PCT/US13/53593 dated Dec. 20, 2013.
International Search Report for PCT/US2015/062483, dated May 6, 2016.
Written Opinion of the International Searching Authority for PCT/US2015/062483, dated May 6, 2016.

* cited by examiner

| Overview | Instructions & Explanations |
|---|---|
| Step 1: Test Equipment Preparation | **Step 1: Test Equipment Preparation**<br>Ensure all tools & materials are available |
| Step 2: Sample Preparation | **Step 2: Sample Preparation**<br>From a cut roll, pull off 3 tissue sample, 2 sheets long<br>Fold in half at perf with embossed side up.<br>Place folded sample on top of cardboard with MD direction parallel with length of board.<br>Flip over sample and cardboard<br>Fold over cut edges<br>Tape securely around cardboard so sample does not move during test<br>Repeat for the remaining 2 samples |
| Step 3: Loading tissue sample on tester | **Step 3: Loading tissue sample on tester**<br>Place 1 cardboard with tissue sample on the lint tester sample deck<br>Line cardboard up with the rubber padding underneath<br>Lock down each end. |
| Step 4: Measuring Felt ***L*** (Before) Value | **Step 4: Measuring Felt *L* (Before) Value**<br>If clean felt has been pre-measured for ***L*** value, skip to step 5<br>Determine the fuzziest side of 3 felt samples by holding the felt up and looking across the top and bottom at the same time.<br>On a Color Touch 2, manufactured by Technidyne Corporation, of New Albany, IN, USA, place felt, fuzzy side up, on the plunger.<br>Press ***Lint*** under ***AutoMeasure,*** then ***Enter,*** then ***Measure***<br>Write the date and ***L*** value on small sticker and place on end of felt strip<br>Store premeasured felt strips in a reclosable plastic bag out of the light |
| Step 5: Felt Preparation for test | **Step 5: Felt Preparation for test**<br>Pull 3 pre-measured felt strips from plastic bag<br>Enter the 3 ***L*** value results on TSE-QA-FO-053 under ***L (Before)***<br>Lay felt, fuzzy side up, on pre-scored cardboard<br>Fold ~1/4" of felt around end of cardboard and tuck inside clip of 4lb weight.<br>Slightly pull felt to fold ~1/4" of felt around the opposite end and tuck in clip to secure<br>Attach weight with felt onto the Sutherland 2000 at the hinge<br>Gently press the right side of the weight so the felt is lying flat and even on the test sample. |
| Step 6: Sutherland 2000 Set up | |
| Step 7: Reading Test Results | |

FIG. 4A

| | |
|---|---|
| | Step 6: Sutherland 2000 Set up |
| | If the Sutherland 2000 is in Sleep Mode, click the START/STOP button to turn machine on.<br>Set the Count to 5 and Speed to SPEED 2<br>Press the START/STOP button to start test<br>When the machine stops, gently remove the 4lb weight with felt by lifting straight up<br>Do not brush across the tissue sample<br>Carefully remove the felt/cardboard from weight<br>Identify sample as 1, 2 or 3 to correspond with its ***L* (Before)** value<br>Lay felt aside and cover with a clean white sheet of paper<br>Dispose of tissue sample in trash can - not Broke - due to possible tape contamination<br>Repeat steps 3 through 6 for the remaining two samples |
| | Step 7: Reading Test Results |
| | Place the 3 separated felt samples inside a re-closable plastic bag.<br>Take samples to the Color Touch 2<br>On the Color Touch 2, place felt, lint side up, on the plunger<br>Press ***Lint*** under ***AutoMeasure***, then ***Enter,*** then ***Measure***<br>Write the ***L*** value under results on TSE-QA-FO-053 under ***L (After)***<br>Subtract the ***L (Before)*** from ***L (After)*** and enter results on form<br>When reading is completed, dispose of felt samples in the trash can. **Do not re-use**.<br>Repeat steps 7 for the remaining 2 samples |

FIG. 4B

SOFT TISSUE PRODUCED USING A STRUCTURED FABRIC AND ENERGY EFFICIENT PRESSING

RELATED APPLICATIONS

The application is a continuation of U.S. patent application Ser. No. 14/951,121, filed Nov. 24, 2016 and entitled SOFT TISSUE PRODUCED USING A STRUCTURED FABRIC AND ENERGY EFFICIENT PRESSING, which in turn claims priority to U.S. Provisional Application Ser. No. 62/083,735, filed Nov. 24, 2015 and entitled SOFT TISSUE PRODUCED USING A STRUCTURED FABRIC AND ENERGY EFFICIENT PRESSING, the contents of these applications being incorporated herein by reference in their entirety.

FIELD OF THE INVENTION

The present invention relates to a paper web, and in particular to a multilayer paper web, that can be converted into soft and strong sanitary and facial tissue products.

BACKGROUND

Across the globe there is great demand for disposable paper products such as sanitary tissue and facial tissue. In the North American market, the demand is increasing for higher quality products offered at a reasonable price point. The quality attributes most important for consumers of disposable sanitary tissue and facial tissue are softness and strength.

Softness is the pleasing tactile sensation the consumers perceive when using the tissue product as it is moved across his or her skin or crumpled in his or her hand. The tissue physical attributes which affect softness are primarily surface smoothness and bulk structure.

The surface smoothness is primarily a function of the surface topography of the web. The surface topography is influenced by the manufacturing method such as conventional dry crepe, through air drying (TAD), or hybrid technologies such as Metso's NTT, Georgia Pacific's ETAD, or Voith's ATMOS process. The manufacturing method of conventional dry crepe creates a surface topography that is primarily influenced by the creping process (doctoring a flat, pressed sheet off of a steam pressurized drying cylinder) versus TAD and hybrid technologies which create a web whose surface topography is influenced primarily by the structured fabric pattern that is imprinted into the sheet and secondarily influenced by the degree of fabric crepe and conventional creping utilized. A structured fabric consists of monofilament polymeric fibers with a weave pattern that creates raised knuckles and depressed valleys to allow for a web with high Z-direction thickness and unique surface topography. Thus, the design of the structured fabric is essential in controlling the softness and quality attributes of the web. U.S. Pat. No. 3,301,746 discloses the first structured or imprinting fabric designed for production of tissue. A structured fabric may also contain an overlaid hardened photosensitive resin to create a unique surface topography and bulk structure as shown in U.S. Pat. No. 4,529,480.

Fabric crepe is the process of using speed differential between a forming and structured fabric to facilitate filling the valleys of the structured fabric with fiber, and folding the web in the Z-direction to create thickness and influence surface topography. Conventional creping is the use of a doctor blade to remove a web that is adhered to a steam heated cylinder, coated with an adhesive chemistry, in conjunction with speed differential between the Yankee dryer and reel drum to fold the web in the Z-direction to create thickness, drape, and to influence the surface topography of the web. The process of calendering, pressing the web between cylinders, will also affect surface topography. The surface topography can also be influenced by the coarseness and stiffness of the fibers used in the web, degree of fiber refining, as well as embossing in the converting process. Added chemical softeners and lotions can also affect the perception of smoothness by creating a lubricious surface coating that reduces friction between the web and the skin of the consumer.

The bulk structure of the web is influenced primarily by web thickness and flexibility (or drape). TAD and Hybrid Technologies have the ability to create a thicker web since structured fabrics, fabric crepe, and conventional creping can be utilized while conventional dry crepe can only utilize conventional creping, and to a lesser extent basis weight/grammage, to influence web thickness. The increase in thickness of the web through embossing does not improve softness since the thickness comes by compacting sections of the web and pushing these sections out of the plane of the web. Plying two or more webs together in the converting process, to increase the finished product thickness, is also an effective method to improve bulk structure softness.

The flexibility, or drape, of the web is primarily affected by the overall web strength and structure. Strength is the ability of a paper web to retain its physical integrity during use and is primarily affected by the degree of cellulose fiber to fiber hydrogen bonding, and ionic and covalent bonding between the cellulose fibers and polymers added to the web. The stiffness of the fibers themselves, along with the degree of fabric and conventional crepe utilized, and the process of embossing will also influence the flexibility of the web. The structure of the sheet, or orientation of the fibers in all three dimensions, is primarily affected by the manufacturing method used.

Conventional Art

The predominant manufacturing method for making a tissue web is the conventional dry crepe process. The major steps of the conventional dry crepe process involve stock preparation, forming, pressing, drying, creping, calendering (optional), and reeling the web. This method is the oldest form of modern tissue making and is thus well understood and easy to operate at high speeds and production rates. Energy consumption per ton is low since nearly half of the water removed from the web is through drainage and mechanical pressing. Unfortunately, the sheet pressing also compacts the web which lowers web thickness resulting in a product that is of low softness and quality. Attempts to improve the web thickness on conventional dry crepe machines have primarily focused on lowering the nip intensity (longer nip width and lower nip pressure) in the press section by using extended nip presses (shoe presses) rather than a standard suction pressure roll. After pressing the sheet, between a suction pressure roll and a steam heated cylinder (referred to as a Yankee dryer), the web is dried from up to 50% solids to up to 99% solids using the steam heated cylinder and hot air impingement from an air system (air cap or hood) installed over the steam cylinder. The sheet is then creped from the steam cylinder using a steel or ceramic doctor blade. This is a critical step in the conventional dry crepe process. The creping process greatly affects softness as the surface topography is dominated by the number and coarseness of the crepe bars (finer crepe is much smoother than coarse crepe). Some thickness and flexibility is also generated during the creping process. After creping, the web is optionally calendered and reeled into a parent roll and ready for the converting process.

The through air dried (TAD) process is another manufacturing method for making a tissue web. The major steps of the through air dried process are stock preparation, forming, imprinting, thermal pre-drying, drying, creping, calendering (optional), and reeling the web. Rather than pressing and compacting the web, as is performed in conventional dry crepe, the web undergoes the steps of imprinting and thermal pre-drying. Imprinting is a step in the process where the web is transferred from a forming fabric to a structured fabric (or imprinting fabric) and subsequently pulled into the structured fabric using vacuum (referred to as imprinting or molding). This step imprints the weave pattern (or knuckle pattern) of the structured fabric into the web. This imprinting step has a tremendous effect on the softness of the web, both affecting smoothness and the bulk structure. The design parameters of the structured fabric (weave pattern, mesh, count, warp and weft monofilament diameters, caliper, air permeability, and optional over-laid polymer) are therefore critical to the development of web softness. After imprinting, the web is thermally pre-dried by moving hot air through the web while it is conveyed on the structured fabric. Thermal pre-drying can be used to dry to the web over 90% solids before it is transferred to a steam heated cylinder. The web is then transferred from the structured fabric to the steam heated cylinder though a very low intensity nip (up to 10 times less than a conventional press nip) between a solid pressure roll and the steam heated cylinder. The only portions of the web that are pressed between the pressure roll and steam cylinder rest on knuckles of the structured fabric, thereby protecting most of the web from the light compaction that occurs in this nip. The steam cylinder and an optional air cap system, for impinging hot air, then dry the sheet to up to 99% solids during the drying stage before creping occurs. The creping step of the process again only affects the knuckle sections of the web that are in contact with the steam cylinder surface. Due to only the knuckles of the web being creped, along with the dominant surface topography being generated by the structured fabric, and the higher thickness of the TAD web, the creping process has much smaller effect on overall softness as compared to conventional dry crepe. After creping, the web is optionally calendered and reeled into a parent roll and ready for the converting process. The following patents describe creped through air dried products: U.S. Pat. Nos. 3,994,771; 4,102,737; 4,529,480; and 5,510,002.

A variation of the TAD process where the sheet is not creped, but rather dried to up to 99% using thermal drying and blown off the structured fabric (using air) to be optionally calendered and reeled also exits. This process is called UCTAD or un-creped through air drying process. U.S. Pat. No. 5,607,551 describes an uncreped through air dried product.

The softness attributes of the TAD process are superior to conventional dry crepe due to the ability to produce superior web bulk structure (thicker, un-compacted) with similar levels of smoothness. Unfortunately, the machinery is roughly double the cost compared to that of a conventional tissue machine and the operational cost is higher due to its energy intensity and complexity to operate.

SUMMMARY OF THE INVENTION

An object of the present invention is to provide a tissue manufacturing method that utilizes a structured fabric in conjunction with a belt press to produce a tissue web, with unique and quantifiable quality and softness attributes, which can be used in the production of sanitary tissue and facial products.

Another object of the present invention is to provide a tissue manufacturing method that avoids the disadvantages associated with wet end additives, and in particular avoids the use of a large amount of additives to achieve the desired quality attributes on the resulting web.

The tissue manufacturing method to produce the web contains a unique dewatering system to maximize web bulk structure by limiting web compaction, and to maximize smoothness by imprinting a fine topographical pattern into the web. In an exemplary embodiment of the manufacturing method, a triple layer headbox is used to deposit a multi-layered slurry of fibers, natural polymers, and synthetic polymers to a nip formed by a forming fabric and structured fabric in a Crescent former configuration.

A tissue product according to an exemplary embodiment of the present invention comprises at least two plies, wherein the tissue has a crumple resistance of less than 30 grams force and an average peak to valley depth of at least 65 microns, and the tissue is produced using a structured or imprinting fabric.

A tissue product according to another exemplary embodiment of the present invention comprises at least two plies, wherein the tissue has a crumple resistance of less than 30 grams force and an average peak to valley depth of at least 100 microns.

In an exemplary embodiment, the tissue product is produced using a process selected from a group of processes consisting of: through air dried, uncreped through air dried, ATMOS, ETAD, or NTT process.

In an exemplary embodiment, the process involves the use of a structured fabric.

In an exemplary embodiment, the structured fabric is of a 5-shed design with a non-consecutive 1,3,5,2,4 warp pick sequence.

In an exemplary embodiment, the structured fabric has a mesh within the range of 40 filaments/inch to 60 filaments/inch.

In an exemplary embodiment, the structured fabric has a count within the range of 25 filaments/inch to 45 filaments/inch.

In an exemplary embodiment, the structured fabric has warp monofilaments with diameters within the range of 0.25 to 0.45 mm.

In an exemplary embodiment, the structured fabric has weft monofilaments with diameters within the range of 0.30 to 0.50 mm.

In an exemplary embodiment, the structured fabric has a web contacting surface that is sanded at the knuckles such that 10% to 35% of the web is supported and imprinted by the sanded surface.

In an exemplary embodiment, the structured fabric has an air permeability value within the range of 500 cfm to 1000 cfm, preferably 500 cfm to 700 cfm.

In an exemplary embodiment, the structured fabric is resistant to at least one of hydrolysis and temperatures which exceed 100 degrees C.

In an exemplary embodiment, a web that makes up one of the first and second plies comprises: a first exterior layer; an interior layer; and a second exterior layer In an exemplary embodiment, the first exterior layer comprises at least 50% virgin hardwood fibers, preferably greater than 75% virgin hardwood fibers, preferably virgin eucalyptus fibers.

In an exemplary embodiment, the interior layer comprises cannabis fibers in an amount within the range of 0% and 10%.

In an exemplary embodiment, the second exterior layer comprises cannabis fibers in an amount within the range of 0% and 10%.

In an exemplary embodiment, the interior layer contains a first wet end additive comprising an ionic surfactant; and a second wet end additive comprising a non-ionic surfactant.

In an exemplary embodiment, the first exterior layer further comprises a wet end temporary wet strength additive.

In an exemplary embodiment, the first exterior layer further comprises a wet end dry strength additive.

In an exemplary embodiment, the second exterior layer further comprises a wet end dry strength additive.

In an exemplary embodiment, the second wet end additive comprises an ethoxylated vegetable oil.

In an exemplary embodiment, the second wet end additive comprises a combination of ethoxylated vegetable oils.

In an exemplary embodiment, the ratio by weight of the second wet end additive to the first wet end additive in the tissue is at least eight to one.

In an exemplary embodiment, the ratio by weight of the second wet end additive to the first wet end additive in the first interior layer is at most ninety to one.

In an exemplary embodiment, the ionic surfactant comprises a debonder.

In an exemplary embodiment, the wet end temporary wet strength additive comprises glyoxalated polyacrylamide.

In an exemplary embodiment, the wet end dry strength additive comprises amphoteric starch.

In an exemplary embodiment, the wet end dry strength additive comprises amphoteric starch.

In an exemplary embodiment, the first and second exterior layers are substantially free of any surface deposited softener agents or lotions.

In an exemplary embodiment, the first exterior layers comprises a surface deposited softener agent or lotion.

In an exemplary embodiment, the non-ionic surfactant has a hydrophilic-lipophilic balance of less than 10.

In an exemplary embodiment, the web is dried from between approximately 30% to approximately 50% solids to up to 99% solids on a steam heated cylinder supplied with a hot air impingement hood.

In an exemplary embodiment, the web is creped from the steam heated cylinder using a steel or ceramic doctor blade between a solids content of approximately 10% to approximately 1% solids.

In an exemplary embodiment, the % crepe between the steam heated cylinder and a reel drum is between approximately 30% to approximately 3%.

In an exemplary embodiment, the tissue product has a web caliper within the range of approximately 400 microns/2 ply to approximately 600 microns/2 ply and is un-calendered.

In an exemplary embodiment, the tissue product has a web caliper within the range of 250 microns/2 ply and 375 microns/2 ply and is calendered.

In an exemplary embodiment, the tissue product has a web caliper within the range of approximately 600 microns/2 ply to approximately 800 microns/2 ply and is uncalendered.

In an exemplary embodiment, the tissue product has a web caliper within the range of approximately 500 microns/2 ply to approximately 700 microns/2 ply and is calendered.

In an exemplary embodiment, the tissue product has a basis weight in $g/m^2$ per 2 ply within the range of approximately 28 $g/m^2$ to 44 $g/m^2$.

In an exemplary embodiment, the tissue product has a machine direction tensile strength per 2 ply within the range of 110 and 190 N/m.

In an exemplary embodiment, the tissue product has a cross machine direction tensile strength per 2 ply within the range of 35 and 90 N/m.

In an exemplary embodiment, the tissue product has a machine direction stretch within the range of 4% to 30% per 2 ply.

In an exemplary embodiment, the tissue product has a cross direction stretch within the range of 4% to 20% per 2 ply.

In an exemplary embodiment, the tissue product has a 2-ply cross direction wet tensile strength within the range of 0 and 25 N/m.

In an exemplary embodiment, the tissue product has a ball burst strength within the range of 150 and 300 gf per 2-ply.

In an exemplary embodiment, the tissue product has a lint value within the range of 2.5 to 7.5 per 2 ply.

In an exemplary embodiment, the tissue product has a softness of a 2-ply sample within the range of 85 TSA and 100 TSA.

In an exemplary embodiment, the bulk softness (TS7) of the tissue product is 10 or less.

In an exemplary embodiment, the web is converted to a rolled 2-ply sanitary tissue product.

In an exemplary embodiment, the web is converted to a folded 2-ply facial tissue product.

In an exemplary embodiment, the web is comprised of at least 50% hardwood fibers, preferably greater than 75% hardwood fibers, preferably eucalyptus fibers.

In an exemplary embodiment, the web is comprised of between 1-10% cannabis fibers.

In an exemplary embodiment, the tissue product has no wet end additives.

In an exemplary embodiment, the web contains a glyoxylated polyacrylamide, an amphoteric starch, and a debonder.

In an exemplary embodiment, the web surface contacting the steam cylinder is free of any surface deposited softener agents or lotions.

In an exemplary embodiment, the web surface contacting the steam cylinder contains surface deposited softener agents or lotions.

In at least one exemplary embodiment, the first exterior layer is comprised of 100% eucalyptus fibers.

In at least one exemplary embodiment, the interior layer contains 10% cannabis fibers, 30% northern bleached softwood kraft fibers, and 60% eucalyptus fibers.

In at least one exemplary embodiment, the second exterior layer contains 10% cannabis fibers, 20% northern bleached softwood kraft fibers, and 70% eucalyptus fibers.

In at least one exemplary embodiment, the interior layer contains a first wet end additive comprising an ionic surfactant, and a second wet end additive comprising the non-ionic surfactant of ethoxylated vegetable oil with a hydrophilic-lipophilic balance of less than 10.

In at least one exemplary embodiment, the ratio by weight of the second wet end additive to the first wet end additive in the interior layer is at least eight to one.

In at least one exemplary embodiment, the first exterior layer further comprises the wet end temporary wet strength additive of glyoxylated polyacrylamide for strength of use when the product is wetted.

In at least one exemplary embodiment, the first exterior layer further comprises the wet end dry strength additive of amphoteric starch for lint control and reduction of refining which reduces web thickness and surface smoothness.

In at least one exemplary embodiment, the second exterior layer further comprises the wet end dry strength additive of amphoteric starch to aid in refining reduction which reduces web thickness and surface smoothness The fibers and polymers from the slurry are predominately collected in the valleys (or pockets, pillows) of the structured fabric as the web is dewatered through the forming fabric. The fabrics separate after the forming roll with the web staying in contact with the structured fabric. At this stage, the web is already imprinted by the structured fabric, but utilization of a vacuum box on the inside of the structured fabric can facilitate further fiber penetration into the structured fabric and a deeper imprint.

In at least one exemplary embodiment, the structured fabric is a 5 shed design with a: warp pick sequence of 1,3,5,2,4, a 51 by 36 yarn/in Mesh and Count, a 0.30 mm warp monofilament, a 0.35 mm weft monofilament, a 0.79 mm caliper, and a 610 cfm.

The web is now transported on the structured fabric to a belt press. In at least one exemplary embodiment, a belt press assembly is utilized to dewater the web while protecting the web from compaction in the valleys of the structured fabric. The belt press includes a permeable belt which presses the non-web contacting surface of the structured fabric while the web is nipped between a permeable dewatering fabric and a vacuum roll. To further assist in water removal, a hot air impingement hood with an installed steam shower is utilized inside the belt press assembly to lower the viscosity of the water in the web. The heated water is removed from the web through the dewatering fabric and vacuum roll. For further energy conservation, a portion of the makeup air used in the hot air impingement hood comes from the exhaust stream of the hot air impingement hood located of the steam heated cylinder.

In at least one exemplary embodiment, the web is then lightly pressed between the dewatering fabric and structured fabric by a second press, composed of one hard and one soft roll, with a vacuum box installed inside the roll under the dewatering fabric to aid in water removal.

In at least one exemplary embodiment, the web is then nipped between a suction pressure roll with a blind and through drilled rubber or polyurethane cover and a steam heated pressure cylinder. Again, the portion of the web inside the valleys is protected from compaction as the web is transferred to the steam heated cylinder. The cylinder is coated with a chemistry to aid in adhering the web to the dryer to facilitate web transfer, heat transfer, and creping efficiency.

In at least one exemplary embodiment, the web is dried across the steam heated cylinder from approximately 50% to 97.5% with the aid of a hot air impingement hood before being removed from the cylinder using a ceramic doctor blade with a creping pocket of 90 degrees.

In at least one exemplary embodiment, the un-calendered caliper of the web is approximately 280 microns/1 ply. The sheet is traveling approximately 15% slower than the steam heated cylinder as it is travels through the calender nip. The caliper of the sheet after creping has been reduced to 200 microns/1 ply. The web is slit and reeled into two or three parent rolls and ready to be converted into a rolled 2-ply sanitary product or folded 2 or 3-ply facial tissue.

In at least one exemplary embodiment, the basis weight of the web is 30 g/m$^2$ per 2 ply.

In at least one exemplary embodiment, the machine direction tensile strength per 2 ply is 140 N/m.

In at least one exemplary embodiment, the cross machine direction tensile strength per 2 ply is 60 N/m.

In at least one exemplary embodiment, the machine direction stretch is 20% per 2 ply.

In at least one exemplary embodiment, the cross direction stretch is 12% per 2 ply.

In at least one exemplary embodiment, the 2-ply cross direction wet tensile is 15 N/m$^2$.

In at least one exemplary embodiment, the ball burst strength is 210 gf per 2-ply.

In at least one exemplary embodiment the lint value is 5.0 per 2 ply.

In at least one exemplary embodiment, TSA of a 2-ply sample is 93.

In at least one exemplary embodiment, TS7 of a 2-ply sample is 8.5.

In at least one exemplary embodiment, the average peak to valley distance is 45 microns.

In at least one exemplary embodiment, the average crumple force resistance is 29 grams force.

In at least one exemplary embodiment, a lotion is applied to the first exterior layer of the web in the converting process.

A papermaking machine according to an exemplary embodiment of the present invention comprises: a nascent web forming section that deposits a nascent web on a structured fabric; a belt press that dewaters the nascent web on the structured fabric; and a drying section that dries the nascent web to form a web for a paper product.

In an exemplary embodiment, the forming section is a Crescent forming section;

In an exemplary embodiment, the forming section is a twin-wire forming section;

In an exemplary embodiment, the papermaking machine further comprises a vacuum box disposed upstream of the belt press for additional dewatering of the nascent web.

In an exemplary embodiment, the drying section comprises a steam heated cylinder.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein:

FIGS. 4A and 4B is a chart providing a lint testing procedure useable with exemplary embodiments of the present invention.

DETAILED DESCRIPTION

Figure 1:
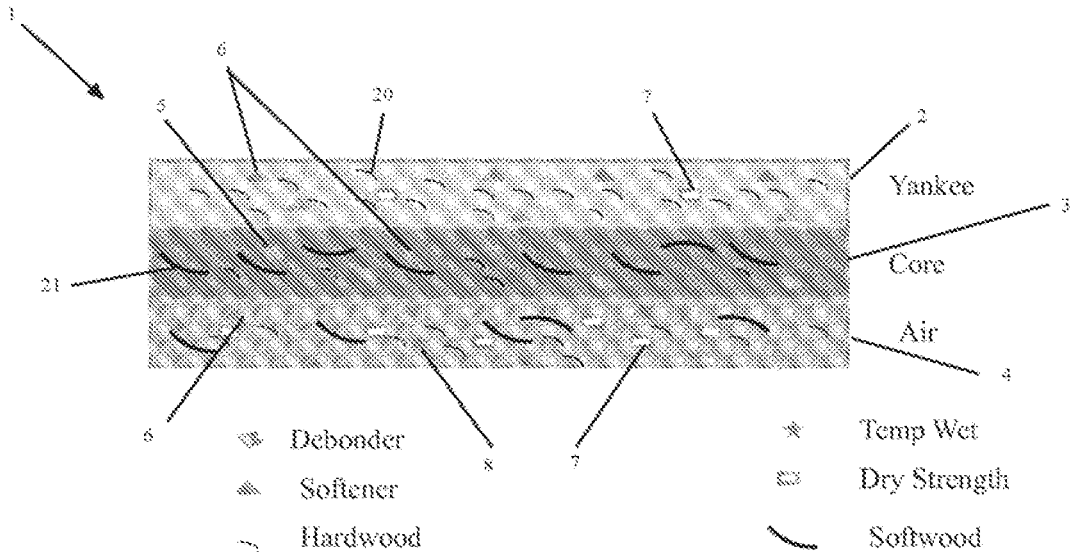
FIG. 1 is a cross-sectional view of a multi-layer tissue according to an exemplary embodiment of the present invention.

An object of the present invention is to provide a paper manufacturing method that utilizes a structured fabric in conjunction with a belt press which can be used in the production of sanitary tissue and facial products, with unique and quantifiable quality and softness attributes.

In at least one exemplary embodiment, the web is a multilayered structure with particular fibers and chemistry added in each layer to maximize quality attributes including web softness. In at least one exemplary embodiment, pulp mixes for each tissue layer are prepared individually.

For the purposes of describing the present invention, the terms "structured tissue product" or "structured paper product" refer to a tissue or other paper product produced using a structured or imprinting fabric.

The present disclosure is related to U.S. patent application Ser. No. 13/837,685 (now U.S. Pat. No. 8,968,517), filed Mar. 15, 2014, the contents of which are incorporated herein by reference in their entirety.

A new process/method and paper machine system for producing tissue has been developed by Voith GmbH, of Heidenheim, Germany, and is being marketed under the name ATMOS (Advanced Tissue Molding System). The process/method and paper machine system has several patented variations, but all involve the use of a structured fabric in conjunction with a belt press. The major steps of the ATMOS process and its variations are stock preparation, forming, imprinting, pressing (using a belt press), creping, calendering (optional), and reeling the web.

The stock preparation step is the same as a conventional or TAD machine would utilize. The purpose is to prepare the proper recipe of fibers, chemical polymers, and additives that are necessary for the grade of tissue being produced, and diluting this slurry to allow for proper web formation when deposited out of the machine headbox (single, double, or triple layered) to the forming surface. The forming process can utilize a twin wire former (as described in U.S. Pat. No. 7,744,726), a Crescent Former with a suction Forming Roll (as described in U.S. Pat. No. 6,821,391), or preferably a Crescent Former (as described in U.S. Pat. No. 7,387,706). The preferred former is provided a slurry from the headbox to a nip formed by a structured fabric (inner position/in contact with the forming roll) and forming fabric (outer position). The fibers from the slurry are predominately collected in the valleys (or pockets, pillows) of the structured fabric and the web is dewatered through the forming fabric. This method for forming the web results in a unique bulk structure and surface topography as described in U.S. Pat. No. 7,387,706 (see, in particular, FIG. 1 through FIG. 11). The fabrics separate after the forming roll with the web staying in contact with the structured fabric. At this stage, the web is already imprinted by the structured fabric, but utilization of a vacuum box on the inside of the structured fabric can facilitate further fiber penetration into the structured fabric and a deeper imprint.

The web is now transported on the structured fabric to a belt press. The belt press can have multiple configurations. The first patented belt press configurations used in conjunction with a structured fabric can be viewed in U.S. Pat. No. 7,351,307 (FIG. 13), where the web is pressed against a dewatering fabric across a vacuum roll by an extended nip belt press. The press dewaters the web while protecting the areas of the sheet within the structured fabric valleys from compaction. Moisture is pressed out of the web, through the dewatering fabric, and into the vacuum roll. The press belt is permeable and allows for air to pass through the belt, web, and dewatering fabric, into the vacuum roll enhancing the moisture removal. Since both the belt and dewatering fabric are permeable, a hot air hood can be placed inside of the belt press to further enhance moisture removal as shown in FIG. 14 of U.S. Pat. No. 7,351,307. Alternately, the belt press can have a pressing device arranged within the belt which includes several press shoes, with individual actuators to control cross direction moisture profile, (see FIG. 28 of U.S. Pat. Nos. 7,951,269 or 8,118,979 or FIG. 20 of U.S. Pat. No. 8,440,055) or a press roll (see FIG. 29 of U.S. Pat. Nos. 7,951,269 or 8,118,979 or FIG. 21 of U.S. Pat. No. 8,440,055). The preferred arrangement of the belt press has the web pressed against a permeable dewatering fabric across a vacuum roll by a permeable extended nip belt press. Inside the belt press is a hot air hood that includes a steam shower to enhance moisture removal. The hot air hood apparatus over the belt press can be made more energy efficient by reusing a portion of heated exhaust air from the Yankee air cap or recirculating a portion of the exhaust air from the hot air apparatus itself (see U.S. Pat. No. 8,196,314). Further embodiments of the drying system composed of the hot air apparatus and steam shower in the belt press section are described in U.S. Pat. Nos. 8,402,673, 8,435,384 and 8,544,184.

After the belt press is a second press to nip the web between the structured fabric and dewatering felt by one hard and one soft roll. The press roll under the dewatering fabric can be supplied with vacuum to further assist water removal. This preferred belt press arrangement is described in U.S. Pat. Nos. 8,382,956, and 8,580,083, with FIG. 1 showing the arrangement. Rather than sending the web through a second press after the belt press, the web can travel through a boost dryer (FIG. 15 of U.S. Pat. Nos. 7,387,706 and 7,351,307), a high pressure through air dryer (FIG. 16 of U.S. Pat. Nos. 7,387,706 and 7,351,307), a two pass high pressure through air dryer (FIG. 17 of U.S. Pat. Nos. 7,387,706 and 7,351,307) or a vacuum box with hot air supply hood (FIG. 2 of U.S. Pat. No. 7,476,293). U.S. Pat. Nos. 7,510,631, 7,686,923, 7,931,781 8,075,739, and 8,092,652 further describe methods and systems for using a belt press and structured fabric to make tissue products each having variations in fabric designs, nip pressures, dwell times, etc. and are mentioned here for reference. A wire turning roll can be also be utilized with vacuum before the sheet is transferred to a steam heated cylinder via a pressure roll nip (see FIG. 2a of U.S. Pat. No. 7,476,293).

The sheet is now transferred to a steam heated cylinder via a press element. The press element can be a through drilled (bored) pressure roll (FIG. 8 of U.S. Pat. No. 8,303,773), a through drilled (bored) and blind drilled (blind bored) pressure roll (FIG. 9 of U.S. Pat. No. 8,303,773), or a shoe press (U.S. Pat. No. 7,905,989). After the web leaves this press element to the steam heated cylinder, the % solids are in the range of 40-50% solids. The steam heated cylinder is coated with chemistry to aid in sticking the sheet to the cylinder at the press element nip and also aid in removal of the sheet at the doctor blade. The sheet is dried to up to 99% solids by the steam heated cylinder and installed hot air impingement hood over the cylinder. This drying process, the coating of the cylinder with chemistry, and the removal of the web with doctoring is explained in U.S. Pat. Nos. 7,582,187 and 7,905,989. The doctoring of the sheet off the Yankee, creping, is similar to that of TAD with only the knuckle sections of the web being creped. Thus the dominant surface topography is generated by the structured fabric, with the creping process having a much smaller effect on overall softness as compared to conventional dry crepe.

The web is now calendered (optional) slit, and reeled and ready for the converting process. These steps are described in U.S. Pat. No. 7,691,230.

The preferred ATMOS process has the following steps: Forming the web using a Crescent Former between an outer forming fabric and inner structured fabric, imprinting the pattern of the structured fabric into the web during forming with the aid of a vacuum box on the inside of the structured fabric after fabric separation, pressing (and dewatering) the web against a dewatering fabric across a vacuum roll using an extended nip belt press belt, using a hot air impingement hood with a steam shower inside the belt press to aid in moisture removal, reuse of exhaust air from the Yankee hot air hood as a percentage of makeup air for the belt press hot air hood for energy savings, use of a second press nip between a hard and soft roll with a vacuum box installed in the roll under the dewatering fabric for further dewatering, transferring the sheet to a steam heated cylinder (Yankee cylinder) using a blind and through drilled press roll (for further dewatering), drying the sheet on the steam cylinder with the aid of a hot air impingement hood over the cylinder, creping, calendering, slitting, and reeling the web.

The benefits of this preferred process are numerous. First, the installed capital cost is only slightly above that of a conventional crescent forming tissue machine and thus nearly half the cost of a TAD machine. The energy costs are equal to that of a conventional tissue machine which are half that of a TAD machine. The thickness of the web is nearly equal to that of a TAD product and up to 100% thicker than a conventional tissue web. The quality of the products produced in terms of softness and strength are comparable to TAD and greater than that produced from a conventional tissue machine. The softness attributes of smoothness and bulk structure are unique and different than that of TAD and Conventional tissue products and are not only a result of the unique forming systems (a high percentage of the fibers collected in the valleys of the structured fabric and are protected from compaction through the process) and dewatering systems (extended nip belted press allows for low nip intensity and less web compaction) of the ATMOS process itself, but also the controllable parameters of the process (fiber selection, chemistry selection, degree of refining, structured fabric utilized, Yankee coating chemistry, creping pocket angle, creping moisture, and amount of calendering).

The ATMOS manufacturing technique is often described as a hybrid technology because it utilizes a structured fabric like the TAD process, but also utilizes energy efficient means to dewater the sheet like the Conventional Dry Crepe process. Other manufacturing techniques which employ the use of a structured fabric along with an energy efficient dewatering process are the ETAD process and NTT process. The ETAD process and products are disclosed in U.S. Pat. Nos. 7,339,378, 7,442,278, and 7,494,563. This process can utilize any type of former such as a Twin Wire Former or Crescent Former. After formation and initial drainage in the forming section, the web is transferred to a press fabric where it is conveyed across a suction vacuum roll for water removal, increasing web solids up to 25%. Then the web travels into a nip formed by a shoe press and backing/transfer roll for further water removal, increasing web solids up to 50%. At this nip, the web is transferred onto the transfer roll and then onto a structured fabric via a nip formed by the transfer roll and a creping roll. At this transfer point, speed differential can be utilized to facilitate fiber penetration into the structured fabric and build web caliper. The web then travels across a molding box to further enhance fiber penetration if needed. The web is then transferred to a Yankee dryer where it can be optionally dried with a hot air impingement hood, creped, calendared, and reeled. The NTT process and products are disclosed in PCT International Patent Application Publication WO 200906709A1. The process has several embodiments, but the key step is the pressing of the web in a nip formed between a structured fabric and press felt. The web contacting surface of the structured fabric is a non-woven material with a three dimensional structured surface comprised of elevation and depressions of a predetermined size and depth. As the web is passed through this nip, the web is formed into the depression of the structured fabric since the press fabric is flexible and will reach down into all of the depressions during the pressing process. When the felt reaches the bottom of the depression, hydraulic force is built up which forces water from the web and into the press felt. To limit compaction of the web, the press rolls will have a long nip width which can be accomplished if one of the rolls is a shoe press. After pressing, the web travels with the structured fabric to a nip with the Yankee dryer, where the sheet is optionally dried with a hot air impingement hood, creped, calendared, and reeled.

FIG. 1 shows a three layer tissue, generally designated by reference number 1, according to an exemplary embodiment of the present invention. The tissue 1 has external layers 2 and 4 as well as an internal, core layer 3. External layer 2 is composed primarily of hardwood fibers 20 whereas external layer 4 and core layer 3 are composed of a combination of hardwood fibers 20 and softwood fibers 1. The internal core layer 3 includes an ionic surfactant functioning as a debonder 5 and a non-ionic surfactant functioning as a softener 6. As explained in further detail below, external layers 2 and 4 also include non-ionic surfactant that migrated from the internal core layer 3 during formation of the tissue 1. External layer 2 further includes a dry strength additive 7. External layer 4 further includes both a dry strength additive 7 and a temporary wet strength additive 8.

Pulp mixes for exterior layers of the tissue are prepared with a blend of primarily hardwood fibers. For example, the pulp mix for at least one exterior layer is a blend containing about 70 percent or greater hardwood fibers relative to the total percentage of fibers that make up the blend. As a further example, the pulp mix for at least one exterior layer is a blend containing about 90-100 percent hardwood fibers relative to the total percentage of fibers that make up the blend.

Pulp mixes for the interior layer of the tissue are prepared with a significant percentage of softwood fibers. For example, the pulp mix for the interior layer is a blend containing about 40 percent or greater softwood fibers relative to the total percentage of fibers that make up the blend. A percentage of the softwood fibers can be replaced with cannabis to limit fiber costs.

As known in the art, pulp mixes are subjected to a dilution stage in which water is added to the mixes so as to form a slurry. After the dilution stage, but prior to reaching the headbox, each of the pulp mixes are dewatered to obtain a thick stock of about 99.5% water. In an exemplary embodiment of the invention, wet end additives are introduced into the thick stock pulp mixes of at least the interior layer. In an exemplary embodiment, a non-ionic surfactant and an ionic surfactant are added to the pulp mix for the interior layer. Suitable non-ionic surfactants have a hydrophilic-lipophilic balance of less than 10 and preferably less than or equal to 8.5. An exemplary non-ionic surfactant is an ethoxylated vegetable oil or a combination of two or more ethoxylated vegetable oils. Other exemplary non-ionic surfactants include ethylene oxide, propylene oxide adducts of fatty alcohols, alkylglycoside esters, and alkylethoxylated esters.

Suitable ionic surfactants include but are not limited to quaternary amines and cationic phospholipids. An exemplary ionic surfactant is 1,2-di(heptadecyl)-3-methyl-4,5-dihydroimidazol-3-ium methyl sulfate. Other exemplary ionic surfactants include (2-hydroxyethyl)methylbis[2-[(1-oxooctadecyl)oxy]ethyl]ammonium methyl sulfate, fatty dialkyl amine quaternary salts, mono fatty alkyl tertiary amine salts, unsaturated alkyl amine salts, linear alkyl sulfonates, alkyl-benzene sulfonates and trimethyl-3-[(1-oxooctadecyl)amino]propylammonium methyl sulfate.

In an exemplary embodiment, the ionic surfactant may function as a debonder while the non-ionic surfactant functions as a softener. Typically, the debonder operates by breaking bonds between fibers to provide flexibility, however an unwanted side effect is that the overall strength of the tissue can be reduced by excessive exposure to debonder. Typical debonders are quaternary amine compounds such as trimethyl cocoammonium chloride, trimethyloleylammonium chloride, dimethydi(hydrogenated-tallow)ammonium chloride and trimethylstearylammonium chloride.

After being added to the interior layer, the non-ionic surfactant (functioning as a softener) migrates through the other layers of the tissue while the ionic surfactant (functioning as a debonder) stays relatively fixed within the interior layer. Since the debonder remains substantially within the interior layer of the tissue, softer hardwood fibers (that may have lacked sufficient tensile strength if treated with a debonder) can be used for the exterior layers. Further, because only the interior of the tissue is treated, less debonder is required as compared to when the whole tissue is treated with debonder.

In an exemplary embodiment, the ratio of ionic surfactant to non-ionic surfactant added to the pulp mix for the interior layer of the tissue is between 1:4 and 1:90 parts by weight and preferably about 1:8 parts by weight. In particular, when the ionic surfactant is a quaternary amine debonder, reducing the concentration relative to the amount of non-ionic surfactant can lead to an improved tissue. Excess debonder, particularly when introduced as a wet end additive, can weaken the tissue, while an insufficient amount of debonder may not provide the tissue with sufficient flexibility. Because of the migration of the non-ionic surfactant to the exterior layers of the tissue, the ratio of ionic surfactant to non-ionic surfactant in the core layer may be significantly lower in the actual tissue compared to the pulp mix.

In an exemplary embodiment, a dry strength additive is added to the thick stock mix for at least one of the exterior layers. The dry strength additive may be, for example, amphoteric starch, added in a range of about 1 to 40 kg/ton. In another exemplary embodiment, a wet strength additive is added to the thick stock mix for at least one of the exterior layers. The wet strength additive may be, for example, glyoxalated polyacrylamide, commonly known as GPAM, added in a range of about 0.25 to 5 kg/ton. In a further exemplary embodiment, both a dry strength additive, preferably amphoteric starch and a wet strength additive, preferably GPAM are added to one of the exterior layers. Without being bound by theory, it is believed that the combination of both amphoteric starch and GPAM in a single layer when added as wet end additives provides a synergistic effect with regard to strength of the finished tissue. Other exemplary temporary wet-strength agents include aldehyde functionalized cationic starch, aldehyde functionalized polyacrylamides, acrolein co-polymers and cis-hydroxyl polysaccharide (guar gum and locust bean gum) used in combination with any of the above mentioned compounds.

In addition to amphoteric starch, suitable dry strength additives may include but are not limited to glyoxalated polyacrylamide, cationic starch, carboxy methyl cellulose, guar gum, locust bean gum, cationic polyacrylamide, polyvinyl alcohol, anionic polyacrylamide or a combination thereof.

Figure 2:
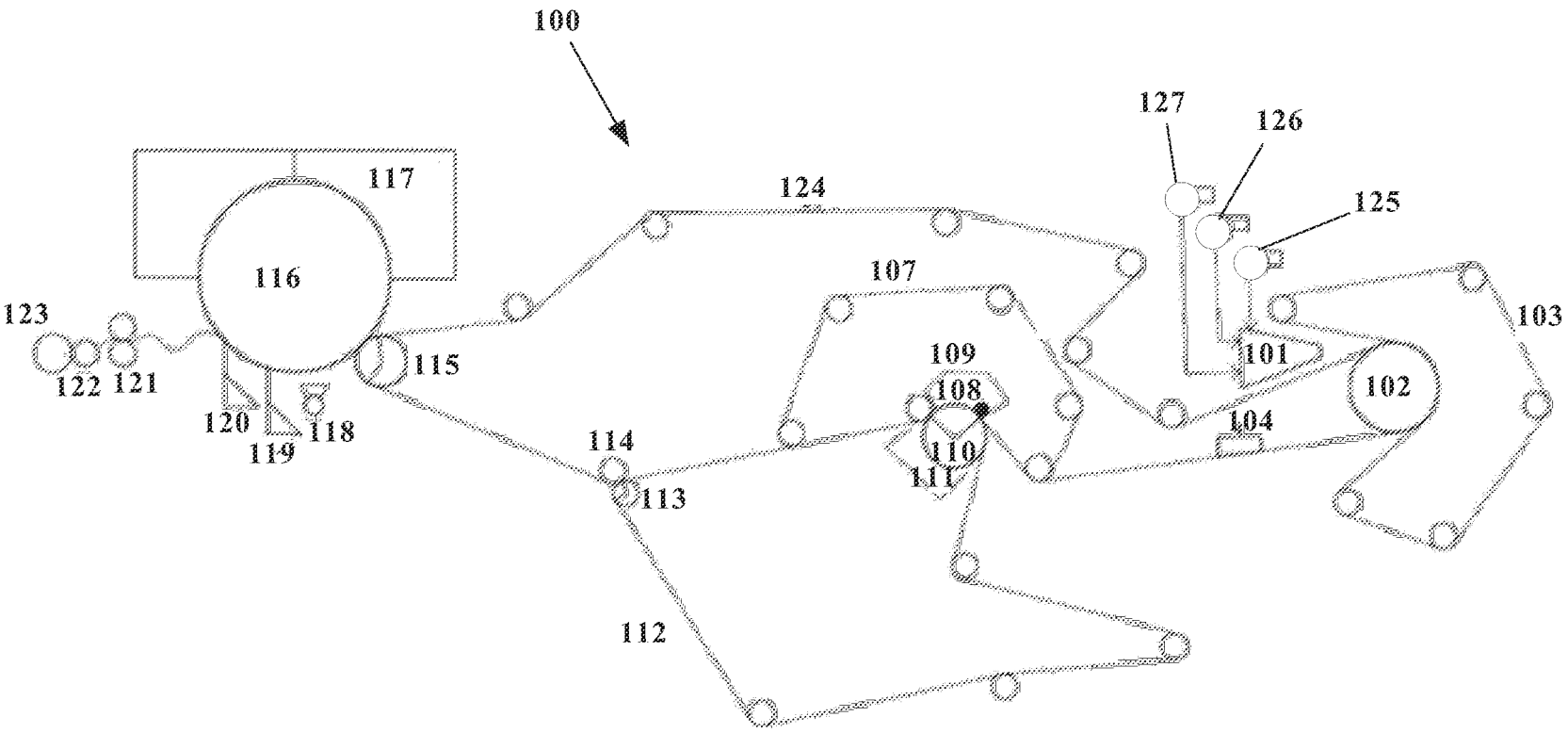
FIG. 2 is a block diagram of a system for manufacturing tissue according to an exemplary embodiment of the present invention.

FIG. 2 is a diagram of a system for manufacturing tissue, generally designated by reference number 100, according to an exemplary embodiment of the present invention. The system includes a first exterior layer fan pump 125, a core layer fan pump 126, and a second exterior layer fan pump 127. The fan pumps move the dilute slurry of fiber and chemicals to a triple layer headbox 101 which deposits the slurry into a nip formed by a forming roll 102, an outer forming wire 103 and structured fabric 124. The slurry is drained through the outer wire 103 to form a web. The web properties at this point are a result of the selection and layering of fibers and chemistry, the formation of the web which influences strength development, and the topographical pattern formed into the sheet by the structured fabric. A smooth surface topography is realized by using low coarseness hardwood fibers in the first exterior layer with no or minimal refining, and a structured fabric with a fine weave pattern. The web has the inclusion of starch for lint control and the inclusion of GPAM to impart a degree of temporary wet strength. The strength of the web is maintained at a level acceptable for use, but low enough to impart a degree of web flexibility and drape. The strength is maintained by using minimal refining of the softwood and cannabis fibers contained in the interior and second exterior layers along with inclusion of the starch polymer which improves the web strength in the Z-direction. Inclusion of an ionic surfactant in the interior layer to debond the fibers also improves sheet flexibility.

After formation, the fabrics separate after the forming roll 102 with the web following the structured fabric 124. A vacuum box 104 is utilized on the inside of the structured fabric to assist with pulling the fibers deeper into the fabric to improve bulk structure and pattern definition. The web is conveyed on the structured fabric 124 to a belt press made up of a permeable belt 107, a permeable dewatering fabric 112, a hot air impingement hood 109 within the belt press containing a steam shower 108, and a vacuum roll 110. The web is heated by the steam and hot air of the hot air impingement hood 109 to lower the viscosity of the water within the web which is being pressed by the belt press to move the water into the dewatering fabric 112 and into the vacuum roll 110. The vacuum roll 110 holds a significant portion of the water within the through and blind drilled holes in the roll cover (rubber or polyurethane) until vacuum is broken at the exit of the vacuum box, upon which time the water is deposited into a save-all pan 111. The air flow through web, provided by the hot air hood and vacuum of the vacuum roll, also facilitates water removal as moisture is trapped in the air stream. At this stage, the web properties are influenced by the structured fabric design and low intensity pressing. The bulk softness of the web is preserved due to the low intensity nip of the belt press which will not compress the web portions within the valleys of the structured fabric. The smoothness of the web is influenced by the unique surface topography imprinted by the structured fabric which is dependent on the parameters of weave pattern, mesh, count, weft and warp monofilament diameter, caliper and % of the fabric that is knuckle verses valley.

The web now travels through a second press comprised of a hard roll 114 and soft or press roll 113. The press roll 113 inside the dewatering fabric 112 contains a vacuum box to facilitate water removal. The web now travels upon the structured fabric 124 to a wire turning roll (not shown) with an optional vacuum box to a nip between a blind and through drilled polyurethane or rubber covered press roll 115 and steam heated pressure cylinder 116. The web solids are up to 50% solids as the web is transferred to the steam heated cylinder 116 that is coated with chemicals that improve web adhesion to the dryer, improve heat transfer through the web, and assist in web removal at the creping doctor 120. The chemicals are constantly being applied at this point using a sprayboom 118, while excess is being removed using a cleaning doctor blade 119. The web is dried by the steam heated cylinder 116 along with an installed hot air impingement hood 117 to a solids content of 97.5%. The web is removed from the steam heated cylinder using a ceramic doctor blade with a pocket angle of 90 degrees at the creping doctor 120. At this stage, the web properties are influenced by the creping action occurring at the creping doctor. A larger creping pocket angle will increase the frequency and fineness of the crepe bars imparted to the web's first exterior surface, which improves surface smoothness. A ceramic doctor blade is preferred, which allows for a fine crepe bar pattern to be imparted to the web for a long duration of time compared to a steel or bimetal blade. Surface smoothness is also increased as the non-ionic surfactant in the core layer migrates to the first and second exterior layer as the heat from the Yankee cylinder and hot air impingement hood draw the surfactant to the surfaces of the web.

The creping action imparted at the blade also improves web flexibility and is a result of the force imparted to the sheet at the crepe blade and is improved as the web adherence to the dryer is increased. The creping force is primarily influenced by the chemistry applied to the steam heated cylinder, the % web contact with the cylinder surface which is a result of the knuckle pattern of the structured fabric, and the percent web solids upon creping.

The web now optionally travels through a set of calenders 121 running 15% slower than the steam heated cylinder 116. The action of calendering improves sheet smoothness but results in lower bulk softness by reducing overall web thickness. The amount of calendering can be influenced by the attributes needed in the finished product. For example; a low sheet count, 2-ply, rolled sanitary tissue product will need less calendering than the same roll of 2-ply sanitary product at a higher sheet count and the same roll diameter and firmness. That is, the thickness of the web may need to be reduced using calendering to allow for more sheets to fit on a roll of sanitary tissue given limitations to roll diameter and firmness. After calendering, the web is reeled using a reel drum 122 into a parent roll 123.

The parent roll can be converted into 1 or 2-ply rolled sanitary products or 1, 2, or 3 ply folded facial tissue products. In addition to the use of wet end additives, the web may also be treated with topical or surface deposited additives in the converting process or on the paper machine after the creping blade. Examples of surface deposited additives include softeners for increasing fiber softness and skin lotions. Examples of topical softeners include but are not limited to quaternary ammonium compounds, including, but not limited to, the dialkyldimethylammonium salts (e.g. ditallowdimethylammonium chloride, ditallowdimethylammonium methyl sulfate, di(hydrogenated tallow)dimethyl ammonium chloride, etc.). Another class of chemical softening agents include the well-known organo-reactive polydimethyl siloxane ingredients, including amino functional polydimethyl siloxane. zinc stearate, aluminum stearate, sodium stearate, calcium stearate, magnesium stearate, spermaceti, and steryl oil.

Figure 3:
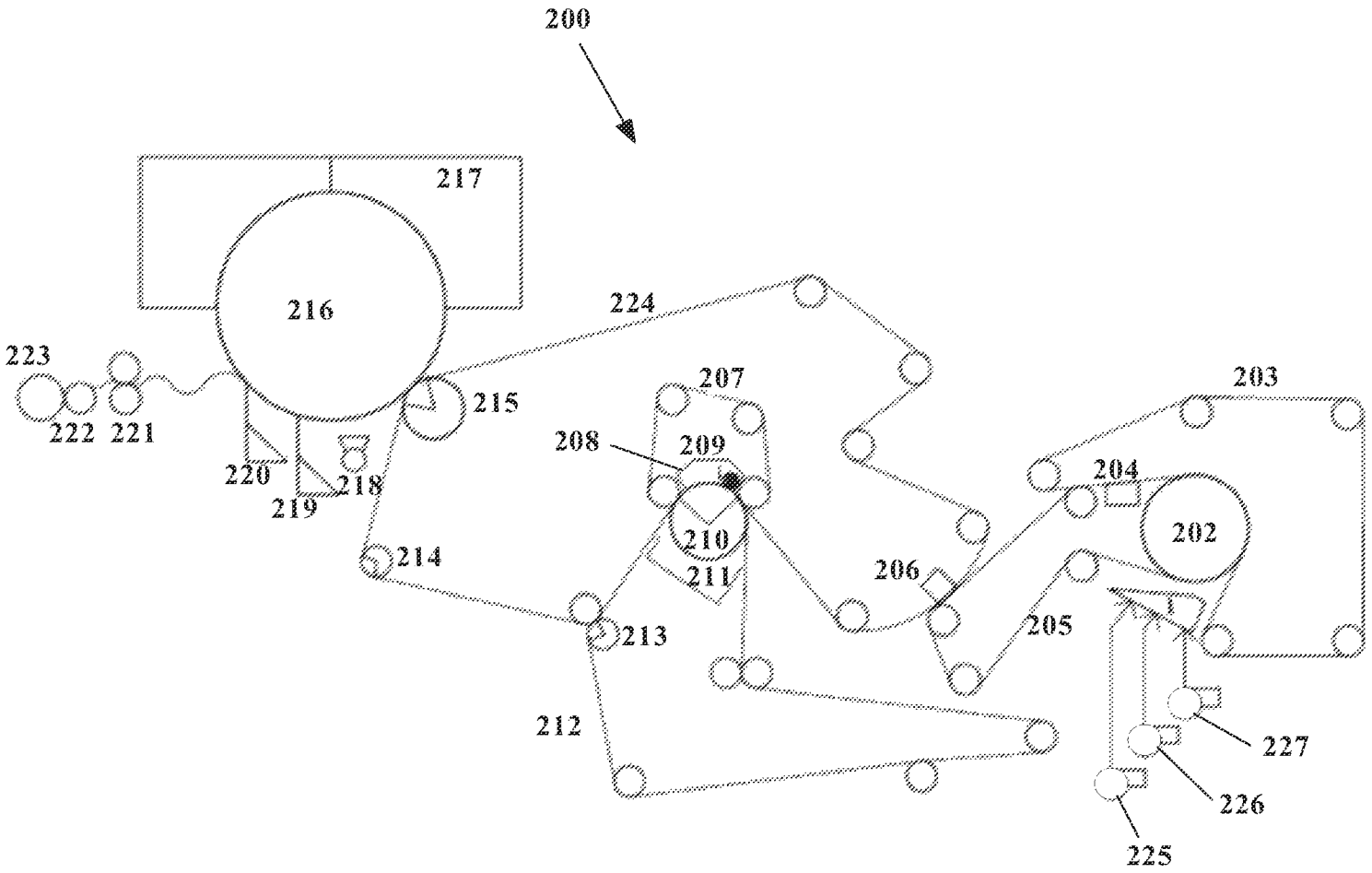
FIG. 3 is a block diagram of a system for manufacturing tissue according to another exemplary embodiment of the present invention.

FIG. 3 is a diagram of a system for manufacturing tissue, generally designated by reference number 200, according to an exemplary embodiment of the present invention. The system includes a first exterior layer fan pump 225, a core layer fan pump 226, and a second exterior layer fan pump 227. The fan pumps 225, 226, 227 move the dilute slurry of fiber and chemicals to a triple layer headbox 201 which deposits the slurry into a nip formed by a forming roll 202, an outer forming wire 203, and an inner forming wire 205. The slurry is drained through the outer wire 203 to form a web. The web properties at this point are a result of the selection and layering of fibers and chemistry along with the formation of the web which influences strength development. A smooth surface topography is realized by using low coarseness hardwood fibers in the first exterior layer with no or minimal refining, the inclusion of starch for lint control, and the inclusion of GPAM to impart a degree of temporary wet strength. The strength of the web is maintained at a level acceptable for use, but low enough to impart a degree of web flexibility and drape. The strength is being maintained by using minimal refining of the softwood and cannabis fibers contained in the interior and second exterior layers along with inclusion of the starch polymer which improves the web strength in the Z-direction. Inclusion of an ionic surfactant in the interior layer to debond the fibers also improves sheet flexibility.

A vacuum box 204 is used to assist in web transfer to the inner wire 205 which conveys the sheet to a structured imprinting fabric 224. A speed differential between the inner wire 205 and structured fabric 224 is utilized to increase web caliper as the web is transferred to the structured fabric 224. A vacuum box or multiple vacuum boxes 206 are used to assist in transfer and imprinting the web using the structured fabric 224 which contains a unique structure dictated by the attributes of fabric. The web portions contacting the valleys of the structure fabric are pulled into these valleys with the assistance of the speed differential and vacuum.

The web is conveyed on the structured fabric 224 to a belt press made up of a permeable belt 207, a permeable dewatering fabric 212, a hot air impingement hood 209 within the belt press containing a steam shower 208, and a vacuum roll 210. The web is heated by the steam and hot air of the hot air impingement hood 209 to lower the viscosity of the water within the web which is being pressed by the belt press to move the water into the dewatering fabric and into the vacuum roll 210. The vacuum roll 210 holds a significant portion of the water within the through and blind drilled holes in the roll cover (rubber or polyurethane) until vacuum is broken at the exit of the vacuum box, upon which time the water is deposited into a save-all pan 211. The air flow through web, provided by the hot air hood 209 and vacuum of the vacuum roll 210, also facilitates water removal as moisture is trapped in the air stream. At this stage, the web properties are influenced by the structured fabric design and low intensity pressing. The bulk softness of the web is preserved due to the low intensity nip of the belt press which will not compress the web portions within the valleys of the structured fabric 212. The smoothness of the web is influenced by the unique surface topography imprinted by the structured fabric 212 which is dependent on the parameters of weave pattern, mesh, count, weft and warp monofilament diameter, caliper and % of the fabric that is knuckle verses valley.

The web now travels through a second press comprised of a hard roll and soft roll. The press roll 213 inside the dewatering fabric 212 contains a vacuum box to facilitate water removal. The web now travels upon the structured fabric 212 to a wire turning roll 214 with an optional vacuum box to a nip between a blind and through drilled polyurethane or rubber covered press roll 215 and steam heated pressure cylinder 216. The web solids are up to 50% solids as the web is transferred to the steam heated cylinder 216 that is coated with chemicals that improve web adhesion to the dryer, improve heat transfer through the web, and assist in web removal at the creping doctor 220. The chemicals are constantly being applied using a sprayboom 218, while excess is being removed using a cleaning doctor blade 219. The web is dried by the steam heated cylinder 216 along with an installed hot air impingement hood 217 to a solids content of 97.5%. The web is removed from the steam heated cylinder 216 using a ceramic doctor blade 220 with a pocket angle of 90 degrees at the creping doctor. At this stage, the web properties are influenced by the creping action occurring at the creping doctor. A larger creping pocket angle will increase the frequency and fineness of the crepe bars imparted to the web's first exterior surface, which improves surface smoothness. The use of a ceramic doctor blade will also allow for a fine crepe bar pattern to be imparted to the web for a long duration of time compared to a steel or bimetal blade and is recommended. Surface smoothness is also increased as the non-ionic surfactant in the core layer migrates to the first and second exterior layer as the heat from the Yankee cylinder 216 and hot air impingement hood 217 draw the surfactant to the surfaces of the web.

The creping action imparted at the blade also improves web flexibility and is a result of the force imparted to the sheet at the crepe blade and is improved as the web adherence to the dryer is increased. The creping force is primarily influenced by the chemistry applied to the steam heated cylinder, the % web contact with the cylinder surface which is a result of the knuckle pattern of the structured fabric, and the percent web solids upon creping.

The web now optionally travels through a set of calendars 221 running, for example, 15% slower than the steam heated cylinder. The action of calendaring improves sheet smoothness but results in lower bulk softness by reducing overall web thickness. The amount of calendaring can be influenced by the attributes needed in the finished product. For example; a low sheet count, 2-ply, rolled sanitary tissue product will need less calendaring than the same roll of 2-ply sanitary product at a higher sheet count and the same roll diameter and firmness. Meaning; the thickness of the web may need to be reduced using calendaring to allow for more sheets to fit on a roll of sanitary tissue given limitations to roll diameter and firmness. After calendaring, the web is reeled using a reel drum 222 into a parent roll 223.

The parent roll 223 can be converted into 1 or 2-ply rolled sanitary products or 1, 2, or 3 ply folded facial tissue products. In addition to the use of wet end additives, the web may also be treated with topical or surface deposited additives in the converting process or on the paper machine after the creping blade. Examples of surface deposited additives include softeners for increasing fiber softness and skin lotions. Examples of topical softeners include but are not limited to quaternary ammonium compounds, including, but not limited to, the dialkyldimethylammonium salts (e.g. ditallowdimethylammonium chloride, ditallowdimethylammonium methyl sulfate, di(hydrogenated tallow)dimethyl ammonium chloride, etc.). Another class of chemical softening agents include the well-known organo-reactive polydimethyl siloxane ingredients, including amino functional polydimethyl siloxane. zinc stearate, aluminum stearate, sodium stearate, calcium stearate, magnesium stearate, spermaceti, and steryl oil.

The below discussed values for softness (i.e., hand feel (HF)), ball burst, caliper, tensile strength, stretch, crumple resistance, peak to valley distance, and basis weight of the inventive tissue were determined using the following test procedures:

Softness Testing

Softness of a 2-ply tissue web was determined using a Tissue Softness Analyzer (TSA), available from EMTECH Electronic GmbH of Leipzig, Germany. A punch was used to cut out three 100 $cm^2$ round samples from the web. One of the samples was loaded into the TSA, clamped into place, and the TPII algorithm was selected from the list of available softness testing algorithms displayed by the TSA. After inputting parameters for the sample, the TSA measurement program was run. The test process was repeated for the remaining samples and the results for all the samples were averaged.

Ball Burst Testing

Ball Burst of a 2-ply tissue web was determined using a Tissue Softness Analyzer (TSA), available from EMTECH Electronic GmbH of Leipzig, Germany using A ball burst head and holder. A punch was used to cut out five 100 $cm^2$ round samples from the web. One of the samples was loaded into the TSA, with the embossed surface facing down, over the holder and held into place using the ring. The ball burst algorithm was selected from the list of available softness testing algorithms displayed by the TSA. The ball burst head was then pushed by the EMTECH through the sample until the web ruptured and the grams force required for the rupture to occur was calculated. The test process was repeated for the remaining samples and the results for all the samples were averaged.

Crumple Testing

Crumple of a 2-ply tissue web was determined using a Tissue Softness Analyzer (TSA), available from EMTECH Electronic GmbH of Leipzig, Germany, using the crumple fixture (33 mm) and base. A punch was used to cut out five 100 $cm^2$ round samples from the web. One of the samples was loaded into the crumple base, clamped into place, and the crumple algorithm was selected from the list of available testing algorithms displayed by the TSA. After inputting parameters for the sample, the crumple measurement program was run. The test process was repeated for the remaining samples and the results for all the samples were averaged. Crumple force is a good measure of the flexibility or drape of the product.

Stretch & MD, CD, and Wet CD Tensile Strength Testing

An Instron 3343 tensile tester, manufactured by Instron of Norwood, Mass., with a 100 N load cell and 25.4 mm rubber coated jaw faces was used for tensile strength measurement. Prior to measurement, the Instron 3343 tensile tester was calibrated. After calibration, 8 strips of 2-ply product, each one inch by four inches, were provided as samples for each test. For testing MD tensile strength, the strips are cut in the MD direction and for testing CD tensile strength the strips are cute in the CD direction. One of the sample strips was placed in between the upper jaw faces and clamp, and then between the lower jaw faces and clamp with a gap of 2 inches between the clamps. A test was run on the sample strip to obtain tensile and stretch. The test procedure was repeated until all the samples were tested. The values obtained for the eight sample strips were averaged to determine the tensile strength of the tissue. When testing CD wet tensile, the strips are placed in an oven at 105 deg Celsius for 5 minutes and saturated with 75 microliters of deionized water immediately prior to pulling the sample.

Lint Testing

The table shown in FIG. 4 describes a lint testing procedure using a Sutherland® 2000™ Rub Tester, manufactured by Danilee Co., of San Antonio, Tex., USA.

Basis Weight

Using a dye and press, six 76.2 mm by 76.2 mm square samples were cut from a 2-ply product being careful to avoid any web perforations. The samples were placed in an oven at 105 deg C. for 5 minutes before being weighed on an analytical balance to the fourth decimal point. The weight of the sample in grams is divided by $(0.0762\ m)^2$ to determine the basis weight in grams/$m^2$.

Caliper Testing

A Thwing-Albert ProGage 100 Thickness Tester, manufactured by Thwing Albert of West Berlin, N.J., USA, was used for the caliper test. Eight 100 mm×100 mm square samples were cut from a 2-ply product. The samples were then tested individually and the results were averaged to obtain a caliper result for the base sheet.

Peak Valley

Peak/Valley of a 2-ply tissue web was determined using a Keyence VHX-1000E microscope available from Keyence Corporation of America, Elmwood Park, N.J., USA, with the following set-up; VHX-1100 camera unit, VHX-S50 free-angle motorized stage, VHX-H3M application software, OP-66871 bayonnet, VH-Z20W lens 20×-200×, and VH-K20 adjustable illumination adapter. An undisturbed sample was taken from the roll and placed on the stage. Using the camera, an un-embossed portion of the web was centered in order to only view the imprinted structured fabric pattern. Using "Depth up/3-D" an image was taken at 100× and measured using the software, across the highest point to the lowest point, this was repeated 5 times moving the stage to various areas on the sheet.

Example 1

A rolled 2-ply sanitary tissue product with 425 sheets, a roll firmness of 6.5, a roll diameter of 133 mm, with sheets a length of 4.25 inches and width of 4.0 inches, was produced using a manufacturing method that utilizes a structured fabric and belt press. The 2-ply tissue product further has the following product attributes: Basis Weight 30 g/$m^2$, Caliper 0.330 mm, MD tensile strength of 160 N/m, CD tensile strength of 65 N/m, a ball burst of 210 grams force, a crumple resistance of 23.9 grams force, a peak to valley depth of 51.3 microns, a lint value of 5.5, an MD stretch of 14%, a CD stretch of 6%, and a CD wet tensile strength of 14 N/m.

The tissue web was multilayered with the fiber and chemistry of each layer selected and prepared individually to maximize product quality attributes of softness and strength. The first exterior layer, which was the layer that contacted the Yankee dryer, was prepared using 100% eucalyptus with 1.0 kg/ton of the amphoteric starch Redibond 2038 (Corn Products, 10 Finderne Avenue, Bridgewater, N.J., USA) (for lint control) and 1.0 kg/ton of the glyoxylated polyacrylamide Hercobond 1194 (Ashland, Wilmington DEL., USA) (for strength when wet). The interior layer was composed of 10% pre-refined and bleached cannabis fibers, 30% northern bleached softwood kraft fibers, 60% eucalyptus fibers, and 1.0 kg/ton of T526, a softener/debonder supplied by EKA (EKA Chemicals Inc., Marietta, Ga., USA). The second exterior layer was composed of 10% pre-refined and bleached cannabis fibers, 20% northern bleached softwood kraft fibers, 70% eucalyptus fibers and 1.0 kg/ton of Redibond 2038 (to limit refining and impart Z-direction strength). The eucalyptus in each layer was lightly refined at 15 kwh/ton to help facilitate better web bonding to the Yankee dryer, while the softwood was refined at 30 kwh/ton to impart the necessary tensile strength.

The fiber and chemicals mixtures were diluted to a solids of 0.5% consistency and fed to separate fan pumps which delivered the slurry to a triple layered headbox. The headbox pH was controlled to 7.0 by addition of a caustic to the thick stock before the fan pumps. The headbox deposited the slurry to a nip formed by a forming roll, an outer forming wire, and structured fabric. The slurry was drained through the outer wire, which is a KT194-P design supplied by Asten Johnson (Charleston, S.C., USA), to aid with drainage, fiber support, and web formation. When the fabrics separated, the web followed the structured fabric which contained a vacuum box inside the fabric run to facilitate with fiber penetration into the structured fabric to enhance bulk softness and web imprinting.

The structured fabric was a P10 design supplied by Voith and was a 5 shed design with a warp pick sequence of 1,3,5,2,4, a 51 by 36 yarn/in Mesh and Count, a 0.30 mm warp monofilament, a 0.35 mm weft monofilament, a 0.79 mm caliper, with a 610 cfm and a knuckle surface that was sanded to impart 27% contact area with the Yankee dryer. The web was transferred to a belt press assembly made up of a permeable belt which pressed the non-web contacting surface of the structured fabric while the web was nipped between a permeable dewatering fabric and a vacuum roll. The vacuum roll was through and blind drilled and supplied with 0.5 bar vacuum while the belt press was supplying 30 kN/meter loading and was of the BW2 design supplied by Voith. A hot air impingement hood installed in the belt press was heating the water in the web using a steam shower at 0.4 bar pressure and hot air at a temperature of 150 deg C. The heated water within the web was pressed into the dewatering fabric which was of the AX2 design supplied by Voith. A significant portion of the water that was pressed into the dewatering fabric was pulled into the vacuum roll blind and bored roll cover and then deposited into the save-all pan after the vacuum was broken at the outgoing nip between the belt press and vacuum roll. Water was also pulled through the vacuum roll and into a separator as the air stream was laden with moisture.

The web then traveled to a second press section and was nipped between the dewatering fabric and structured fabric using a hard and soft roll. The roll under the dewatering fabric was supplied with 0.5 bar vacuum to assist further with water removal. The web then traveled with the structured fabric to the suction pressure roll, while the dewatering fabric was conditioned using showers and a uhle box to remove contaminants and excess water. The web was nipped up to 50 pli of force at the pressure roll nip while 0.5 bar vacuum was applied to further remove water.

The web was at that point 50% solids and was transferred to the Yankee dryer that was coated with the Magnos coating package supplied by Buckman (Memphis, Tenn., U.S.A.). This coating package contains adhesive chemistries to provide wet and dry tact, film forming chemistries to provide an even coating film, and modifying chemistries to harden or soften the coating to allow for proper removal of coating remaining at the cleaning blade. The web in the valley portions of the fabric was protected from compaction, while the web portion on the knuckles of the fabric (27% of the web) was lightly compacted at the pressure roll nip. The knuckle pattern was further imprinted into the web at this nip.

The web then traveled on the Yankee dryer and held in intimate contact with the Yankee surface by the coating chemistry. The Yankee was provided steam at 0.7 bar and 125 deg C., while the installed hot air impingement hood over the Yankee was blowing heated air at 450 deg C. The web was creped from the Yankee at 15% crepe using a ceramic blade at a pocket angle of 90 degrees. The caliper of the web was approximately 300 microns before traveling through the calender to reduce the caliper to 200 microns. The web was cut into two of equal width using a high pressure water stream at 10,000 psi and reeled into two equally sized parent rolls and transported to the converting process.

In the converting process, the two webs were plied together using mechanical ply bonding, or light embossing using the DEKO configuration (only the top sheet is embossed with glue applied to the inside of the top sheet at the high points derived from the embossments using an adhesive supplied by a cliché roll) with the second exterior layer of each web facing each other. The product was wound into a 425 sheet count product at 133 mm. Alternately, the web was not calendered on the paper machine and the web was converted as described above, but was wound into a 330 count product at 133 mm with nearly the same physical properties as described previously.

Alternately; in the converting process, the first exterior surface of the two webs were covered with a softener chemistry using a wet chemical applicator supplied by WEKO (Spartanburg, S.C., USA). The webs were then plied together using mechanical ply bonding and folded into a 2-ply facial product.

Example 2

A rolled 2-ply sanitary tissue product with 190 sheets, a roll firmness of 6.0, a roll diameter of 121 mm, with sheets having a length of 4.0 inches and width of 4.0 inches, was produced using a manufacturing method that utilized a structured fabric and belt press. The 2-ply tissue product further had the following product attributes: Basis Weight 39 g/m$^2$, Caliper 550 mm, MD tensile strength of 165 N/m, CD tensile strength of 75 N/m, a ball burst of 230 grams force, a crumple resistance of 30 grams force, a peak to valley depth of 110 microns, a lint value of 5.5, an MD stretch of 14%, a CD stretch of 6%, and a CD wet tensile strength of 18 N/m.

The tissue web was multilayered with the fiber and chemistry of each layer selected and prepared individually to maximize product quality attributes of softness and strength. The first exterior layer, which was the layer intended for contact with the Yankee dryer, was prepared using 100% eucalyptus with 1.0 kg/ton of the amphoteric starch Redibond 2038 (for lint control) and 1.0 kg/ton of the glyoxylated polyacrylamide Hercobond 1194 (for strength when wet). The interior layer was composed of 40% northern bleached softwood kraft fibers, 60% eucalyptus fibers, and 1.5 kg/ton of T526, a softener/debonder. The second exterior layer was composed of 20% northern bleached softwood kraft fibers, 80% eucalyptus fibers and 1.0 kg/ton of Redibond 2038 (to limit refining and impart Z-direction strength). The eucalyptus in each layer was lightly refined at 15 kwh/ton to help facilitate better web bonding to the Yankee dryer, while the softwood was refined at 20 kwh/ton to impart the necessary tensile strength.

The fiber and chemicals mixtures were diluted to a solids of 0.5% consistency and fed to separate fan pumps which delivered the slurry to a triple layered headbox. The headbox pH was controlled to 7.0 by addition of a caustic to the thick stock before the fan pumps. The headbox deposited the slurry to a nip formed by a forming roll, an outer forming wire, and structured fabric. The slurry was drained through the outer wire, which was a KT194-P design supplied by Asten Johnson, to aid with drainage, fiber support, and web formation. When the fabrics separated, the web followed the structured fabric which contained a vacuum box inside the fabric run to facilitate with fiber penetration into the structured fabric to enhance bulk softness and web imprinting.

The structured fabric was a Prolux 005 design supplied by Albany (Rochester, N.H., USA) and was a 5 shed design with a warp pick sequence of 1,3,5,2,4, a 17.8 by 11.1 yarn/cm Mesh and Count, a 0.35 mm warp monofilament, a 0.50 mm weft monofilament, a 1.02 mm caliper, with a 640 cfm and a knuckle surface that was sanded to impart 27% contact area with the Yankee dryer. The web was transferred to a belt press assembly made up of a permeable belt which pressed the non-web contacting surface of the structured fabric while the web was nipped between a permeable dewatering fabric and a vacuum roll. The vacuum roll was through and blind drilled and supplied with 0.5 bar vacuum while the belt press was supplying 30 kN/meter loading and was of the BW2 design supplied by Voith. A hot air impingement hood installed in the belt press was heating the water in the web using a steam shower at 0.4 bar pressure and hot air at a temperature of 150 deg C. The heated water within the web was pressed into the dewatering fabric which was of the AX2 design supplied by Voith. A significant portion of the water that was pressed into the dewatering fabric was pulled into the vacuum roll blind and bored roll cover and then deposited into the save-all pan after the vacuum was broken at the outgoing nip between the belt press and vacuum roll. Water was also pulled through the vacuum roll and into a vacuum separator as the air stream was laden with moisture.

The web then traveled to a second press section and was nipped between the dewatering fabric and structured fabric using a hard and soft roll. The roll under the dewatering fabric was supplied with 0.5 bar vacuum to assist further with water removal. The web then traveled with the structured fabric to the suction pressure roll, while the dewatering fabric was conditioned using showers and a uhle box to remove contaminants and excess water. The web was nipped up to 50 pli of force at the pressure roll nip while 0.5 bar vacuum was applied to further remove water.

The web was now 50% solids and was transferred to the Yankee dryer that was coated with the Magnos coating package supplied by Buckman. This coating package contains adhesive chemistries to provide wet and dry tact, film forming chemistries to provide an even coating film, and modifying chemistries to harden or soften the coating to allow for proper removal of coating remaining at the cleaning blade. The web in the valley portion of the fabric was protected from compaction, while the web portion on the knuckles of the fabric (27% of the web) was lightly compacted at the pressure roll nip. The knuckle pattern was further imprinted into the web at this nip.

The web then traveled on the Yankee dryer and held in intimate contact with the Yankee surface by the coating chemistry. The Yankee provided steam at 0.7 bar and 125 deg C., while the installed hot air impingement hood over the Yankee was blowing heated air at 450 deg C. The web was creped from the Yankee at 15% crepe using a ceramic blade at a pocket angle of 90 degrees. The caliper of the web was approximately 375 microns before traveling through the calender to reduce the caliper to 275 microns. The web was cut into two of equal width using a high pressure water stream at 10,000 psi and reeled into two equally sized parent rolls and transported to the converting process.

In the converting process, the two webs were plied together using mechanical ply bonding, or light embossing of the DEKO configuration (only the top sheet is embossed with glue applied to the inside of the top sheet at the high points derived from the embossments using and adhesive supplied by a cliché roll) with the second exterior layer of each web facing each other. The product was wound into a 190 sheet count product at 121 mm. Alternately, the web was not calendered on the paper machine and the web was converted as described above, but was wound into a 176 count product at 121 mm with nearly the same physical properties as described previously.

Alternately; in the converting process, the first exterior surface of the two webs were covered with a softener chemistry using a wet chemical applicator supplied by WEKO. The webs were then plied together using mechanical ply bonding and folded into a 2-ply facial product.

Example 3

A rolled 2-ply sanitary tissue product with 425 sheets, a roll firmness of 6.5, a roll diameter of 133 mm, with sheets having a length of 4.25 inches and width of 4.0 inches, was produced using a manufacturing method that utilized a structured fabric and belt press. The 2-ply tissue product further had the following product attributes: Basis Weight 30 g/m$^2$, Caliper 0.330 mm, MD tensile strength of 160 N/m, CD tensile strength of 65 N/m, a ball burst of 210 gf, a crumple resistance of 23.9 grams force, a peak to valley depth of 51.3 microns, a crumple resistance of 30 grams force, a peak to valley depth of 110 microns, a lint value of 5.5, an MD stretch of 14%, a CD stretch of 6%, and a CD wet tensile strength of 14 N/m.

The tissue web was multilayered with the fiber and chemistry of each layer selected and prepared individually to maximize product quality attributes of softness and strength. The first exterior layer, which was intended for contact with the Yankee dryer, was prepared using 100% eucalyptus with 1.0 kg/ton of the amphoteric starch Redibond 2038 and 1.0 kg/ton of the glyoxylated polyacrylamide Hercobond 1194. The interior layer was composed of 10% pre-refined and bleached cannabis fibers, 30% northern bleached softwood kraft fibers, 60% eucalyptus fibers, and 1.0 kg/ton of T526 a softener/debonder supplied by EKA. The second exterior layer was composed of 10% pre-refined and bleached cannabis fibers, 20% northern bleached softwood kraft fibers, 70% eucalyptus fibers and 1.0 kg/ton of Redibond 2038 (to limit refining and impart Z-direction strength). The eucalyptus in each layer was lightly refined at 15 kwh/ton to help facilitate better web bonding to the Yankee dryer, while the softwood was refined at 30 kwh/ton to impart the necessary tensile strength.

The fiber and chemicals mixtures were diluted to a solids of 0.5% consistency and fed to separate fan pumps which delivered the slurry to a triple layered headbox. The headbox pH was controlled to 7.0 by addition of a caustic to the thick stock before the fan pumps. The headbox deposited the slurry to a nip formed by two forming fabrics in a twin wire former configuration. The web was drained through the outer forming fabric, which was an Integra T design supplied by Asten Johnson, to aid with drainage, fiber support, and web formation. The inner wire was of the 194-P design from Asten Johnson, used for better web release and minimal fiber carryback. When the forming fabrics separates, the web followed the inner wire with the aid of a vacuum box installed under the inner wire.

The web was transferred to a structured fabric using 5% fabric crepe to generate additional caliper. The sheet was imprinted using a 4 slotted vacuum box with 1" slots supplying 50 kPA of vacuum. The structured fabric was a P10 design supplied by Voith and was a 5 shed design with a warp pick sequence of 1,3,5,2,4, a 51 by 36 yarn/in Mesh and Count, a 0.30 mm warp monofilament, a 0.35 mm weft monofilament, a 0.79 mm caliper, with a 610 cfm and a knuckle surface that was sanded to impart 27% contact area with the Yankee dryer. The web was transferred to a belt press assembly made up of a permeable belt which pressed the non-web contacting surface of the structured fabric while the web was nipped between a permeable dewatering fabric and a vacuum roll. The vacuum roll was through and blind drilled and supplied with 0.5 bar vacuum while the belt press was supplying 30 kN/meter loading and was of the BW2 design supplied by Voith. A hot air impingement hood installed in the belt press was heating the water in the web using a steam shower at 0.4 bar pressure and hot air at a temperature of 150 deg C. The heated water within the web was pressed into the dewatering fabric which was of the AX2 design supplied by Voith. A significant portion of the water that was pressed into the dewatering fabric was pulled into the vacuum roll blind and bored roll cover and then deposited into the save-all pan after the vacuum was broken at the outgoing nip between the belt press and vacuum roll. Water was also pulled through the vacuum roll and into a separator as the air stream was laden with moisture.

The web then traveled to a second press section and was nipped between the dewatering fabric and structured fabric using a hard and soft roll. The roll under the dewatering fabric was supplied with 0.5 bar vacuum to assist further with water removal. The web then traveled with the structured fabric to the wire turning roll, while the dewatering fabric was conditioned using showers and a uhle box to remove contaminants and excess water. The wire turning roll was also supplied with 0.5 bar vacuum to aid in further water removal before the web was nipped between a suction pressure roll and the Yankee dryer. The web was nipped up to 50 pli of force at the pressure roll nip while 0.5 bar vacuum was applied to further remove water.

The web was then 50% solids and was transferred to the Yankee dryer that was coated with the Magnos coating package supplied by Buckman. This coating package contains adhesive chemistries to provide wet and dry tact, film forming chemistries to provide an even coating film, and modifying chemistries to harden or soften the coating to allow for proper removal of coating remaining at the cleaning blade. The web in the valley portions of the fabric was protected from compaction, while the web portion on the knuckles of the fabric (27% of the web) was lightly compacted at the pressure roll nip. The knuckle pattern was further imprinted into the web at this nip.

The web then traveled on the Yankee dryer and was held in intimate contact with the Yankee surface by the coating chemistry. The Yankee provided steam at 0.7 bar and 125 deg C., while the installed hot air impingement hood over the Yankee was blowing heated air at 450 deg C. The web was creped from the Yankee at 15% crepe using a ceramic blade at a pocket angle of 90 degrees. The caliper of the web was approximately 300 microns before traveling through the calendar to reduce the caliper to 200 microns. The web was cut into two of equal width using a high pressure water stream at 10,000 psi and reeled into two equally sized parent rolls and transported to the converting process.

In the converting process, the two webs were plied together using mechanical ply bonding, or light embossing using the DEKO configuration (only the top sheet is embossed with glue applied to the inside of the top sheet at the high points derived from the embossments using an adhesive supplied by a cliché roll) with the second exterior layer of each web facing each other. The product was wound into a 425 sheet count product at 133 mm. Alternately, the web was not calendared on the paper machine and the web was converted as described above, but was wound into a 330 count product at 133 mm with nearly the same physical properties as described previously.

Alternately; in the converting process, the first exterior surface of the two webs were covered with a softener chemistry using a wet chemical applicator supplied by WEKO. The webs were then plied together using mechanical ply bonding and folded into a 2-ply facial product.

Example 4

A rolled 2-ply sanitary tissue product with 190 sheets, a roll firmness of 6.0, a roll diameter of 121 mm, with sheets having a length of 4.0 inches and width of 4.0 inches, was produced using a manufacturing method that utilizes a structured fabric and belt press. The 2-ply tissue product further had the following product attributes: Basis Weight 39 g/m$^2$, Caliper 0.550 mm, MD tensile strength of 165 N/m, CD tensile strength of 75 N/m, a ball burst of 230 gf, a lint value of 5.5, an MD stretch of 14%, a CD stretch of 6%, and a CD wet tensile strength of 18 N/m.

The tissue web was multilayered with the fiber and chemistry of each layer selected and prepared individually to maximize product quality attributes of softness and strength. The first exterior layer, which was the layer intended for contact with the Yankee dryer, was prepared using 100% eucalyptus with 1.0 kg/ton of the amphoteric starch Redibond 2038 (for lint control) and 1.0 kg/ton of the glyoxylated polyacrylamide Hercobond 1194 (for strength when wet). The interior layer was composed of 40% northern bleached softwood kraft fibers, 60% eucalyptus fibers, and 1.5 kg/ton of T526, a softener/debonder. The second exterior layer was composed of 20% northern bleached softwood kraft fibers, 80% eucalyptus fibers and 1.0 kg/ton of Redibond 2038 (to limit refining and impart Z-direction strength). The eucalyptus in each layer was lightly refined at 15 kwh/ton to help facilitate better web bonding to the Yankee dryer, while the softwood was refined at 20 kwh/ton to impart the necessary tensile strength.

The fiber and chemical mixtures were diluted to a solids of 0.5% consistency and fed to separate fan pumps which delivered the slurry to a triple layered headbox. The headbox pH was controlled to 7.0 by addition of a caustic to the thick stock before the fan pumps. The headbox deposited the slurry to a nip formed by two forming fabrics in a twin wire former configuration. The web was drained through the outer forming fabric, which was an Integra T design supplied by Asten Johnson, to aid with drainage, fiber support, and web formation. The inner wire was of the 194-P design from Asten Johnson, used for better web release and minimal fiber carryback. When the forming fabrics separate, the web followed the inner wire with the aid of a vacuum box installed under the inner wire.

The web was transferred to a structured fabric using 0% fabric crepe. The sheet was imprinted using a 4 slotted vacuum box with 1" slots supplying 50 kPA of vacuum. The structured fabric was a Prolux 005 design supplied by Albany and was a 5 shed design with a warp pick sequence of 1,3,5,2,4, a 17.8 by 11.1 yarn/cm Mesh and Count, a 0.35 mm warp monofilament, a 0.50 mm weft monofilament, a 1.02 mm caliper, with a 640 cfm and a knuckle surface that was sanded to impart 27% contact area with the Yankee dryer. The web was transferred to a belt press assembly made up of a permeable belt which pressed the non-web contacting surface of the structured fabric while the web was nipped between a permeable dewatering fabric and a vacuum roll. The vacuum roll was through and blind drilled and supplied with 0.5 bar vacuum while the belt press was supplying 30 kN/meter loading and was of the BW2 design supplied by Voith. A hot air impingement hood installed in the belt press was heating the water in the web using a steam shower at 0.4 bar pressure and hot air at a temperature of 150 deg C. The heated water within the web was pressed into the dewatering fabric which was of the AX2 design supplied by Voith. A significant portion of the water that was pressed into the dewatering fabric was pulled into the vacuum roll blind and bored roll cover and then deposited into the save-all pan after the vacuum was broken at the outgoing nip between the belt press and vacuum roll. Water was also pulled through the vacuum roll and into a vacuum separator as the air stream was laden with moisture.

The web then traveled to a second press section and was nipped between the dewatering fabric and structured fabric using a hard and soft roll. The roll under the dewatering fabric was supplied with 0.5 bar vacuum to assist further with water removal. The web then traveled with the structured fabric to the wire turning roll, while the dewatering fabric was conditioned using showers and a uhle box to remove contaminants and excess water. The wire turning roll was also supplied with 0.5 bar vacuum to aid in further water removal before the web was nipped between a suction pressure roll and the Yankee dryer. The web was nipped up to 50 pli of force at the pressure roll nip while 0.5 bar vacuum was applied to further remove water.

The web was then 50% solids and was transferred to the Yankee dryer that was coated with the Magnos coating package supplied by Buckman. This coating package contains adhesive chemistries to provide wet and dry tact, film forming chemistries to provide an even coating film, and modifying chemistries to harden or soften the coating to allow for proper removal of coating remaining at the cleaning blade. The web in the valley portion of the fabric was protected from compaction, while the web portion on the knuckles of the fabric (27% of the web) was lightly compacted at the pressure roll nip. The knuckle pattern was further imprinted into the web at this nip.

The web then traveled on the Yankee dryer and was held in intimate contact with the Yankee surface by the coating chemistry. The Yankee was provided steam at 0.7 bar and 125 deg C., while the installed hot air impingement hood over the Yankee was blowing heated air at 450 deg C. The web was creped from the Yankee at 15% crepe using a ceramic blade at a pocket angle of 90 degrees. The caliper of the web was approximately 375 microns before traveling through the calendar to reduce the caliper to 275 microns. The web was cut into two of equal width using a high pressure water stream at 10,000 psi and reeled into two equally sized parent rolls and transported to the converting process.

In the converting process, the two webs were plied together using mechanical ply bonding, or light embossing of the DEKO configuration (only the top sheet is embossed with glue applied to the inside of the top sheet at the high points derived from the embossments using and adhesive supplied by a cliché roll) with the second exterior layer of each web facing each other. The product was wound into a 190 sheet count product at 121 mm. Alternately, the web was not calendared on the paper machine and the web was converted as described above, but was wound into a 176 count product at 121 mm with nearly the same physical properties as described previously.

Alternately; in the converting process, the first exterior surface of the two webs were covered with a softener chemistry using a wet chemical applicator supplied by WEKO. The webs were then plied together using mechanical ply bonding and folded into a 2-ply facial product.

Table 1 below provides values for the peak-to-valley depth, crumple resistance and caliper of Examples 1-4 as compared to conventional products made by either conventional creping, TAD, NTT, ETAD or UCTAD processes. As can be appreciated from the data, the tissue products of Examples 1-4 generally exhibit greater peak to valley depth and caliper as compared to conventionally creped products along with reduced crumple resistance as compared to other 2-ply tissue products made using a structured fabric. A tissue product according to an exemplary embodiment of the present invention is a structured tissue having at least two plies, wherein the tissue has a crumple resistance of less than 30 grams force, an average peak to valley depth of at least 65 microns, preferably at least 100 microns, and a caliper of at least 450 microns/2 ply. Further, the use of both structured fabric and creping in the inventive process results in two distinct microstructure patterns formed in the tissue web, as opposed to only a single microstructure pattern formed in products made using only conventional creping.

TABLE 1

| PRODUCT | Technology | Peak to Valley Depth [microns] | Crumple resistance [g-Force] | Number of Plies | Basis Wt [gsm] | Caliper [microns] |
|---|---|---|---|---|---|---|
| EXAMPLE 1 | ATMOS | 51 | 23.9 | 2 | 31 | 271 |
| EXAMPLE 2 | ATMOS | 110 | 29.0 | 2 | 39 | 620 |
| EXAMPLE 3 | ATMOS | 44 | 29.0 | 2 | 31 | 329 |
| EXAMPLE 4 | ATMOS | 108 | 25.0 | 2 | 39 | 550 |
| Kroger | Conventional Creping | 27 | 12.6 | 1 | 17 | 168 |
| Sam's Club Mexico | NTT | 27 | 20.0 | 2 | 33 | 273 |
| Walmart Southeast - Quilted Northern Ultra | Conventional Creping | 48 | 42.8 | 3 | 56 | 538 |
| Costco Southeast - Kirkland Signature | Conventional Creping | 55 | 21.0 | 2 | 38 | 327 |
| Walmart Southeast - Angel Soft | Conventional Creping | 61 | 29.4 | 2 | 37 | 477 |
| Canada East - Pres Choice Max | TAD | 101 | 50.8 | 2 | 46 | 489 |
| Walmart Southeast - Charmin Soft MEGA | TAD | 142 | 31.6 | 2 | 47 | 488 |
| Walmart West - Great Value Ultra Soft | TAD | 144 | 45.9 | 2 | 47 | 454 |
| Walmart Southeast - Charmin Strong MEGA | TAD | 150 | 43.0 | 2 | 38 | 406 |
| Walmart Southeast - Charmin Soft Regular | TAD | 154 | 47.1 | 2 | 47 | 580 |
| Walmart West - Quilted Northern Soft and Strong | ETAD | 163 | 37.7 | 2 | 46 | 501 |
| Walmart Southeast - Charmin Basic | TAD | 166 | 25.7 | 1 | 31 | 347 |
| Walmart Southeast - Charmin Strong Reg Roll | TAD | 167 | 48.6 | 2 | 36 | 386 |
| Sam's Club Mexico | NTT | 192 | 25.7 | 2 | 31 | 401 |
| First Quality Soft Bath | TAD | 220 | 40.4 | 2 | 39 | 624 |
| First Quality Strong Bath | TAD | 245 | 43.9 | 2 | 36 | 589 |
| Walmart Southeast - Cottonelle Clean Care | UCTAD | 468 | 81.2 | 1 | 40 | 601 |
| Walmart Southeast - Cottonelle Ultra | UCTAD | 473 | 65.9 | 2 | 43 | 702 |

As known in the art, the tissue web is subjected to a converting process at or near the end of the web forming line to improve the characteristics of the web and/or to convert the web into finished products. On the converting line, the tissue web may be unwound, printed, embossed and rewound. According to an exemplary embodiment of the invention, the paper web on the converting lines may be treated with corona discharge before the embossing section. This treatment may be applied to the top ply and/or bottom ply. Nano cellulose fibers (NCF), nano crystalline cellulose (NCC), micro-fibrillated cellulose (MCF) and other shaped natural and synthetic cellulose based fibers may be blown on to the paper web using a blower system immediately after corona treatment. This enables the nano-fibers to adsorb on to the paper web through electro-static interactions.

Now that embodiments of the present invention have been shown and described in detail, various modifications and improvements thereon will become readily apparent to those skilled in the art. Accordingly, the spirit and scope of the present invention is to be construed broadly and not limited by the foregoing specification.

The invention claimed is:

1. A structured tissue product comprising at least two plies, wherein the structured tissue product has a crumple resistance of less than 30 grams force, a caliper of at least 450 microns/ply, and a softness of 85 TSA to 100 TSA, wherein:

a web that makes up one of the at least two plies comprises a first exterior layer, an interior layer and a second exterior layer;

the interior layer contains a first wet end additive comprising an ionic surfactant and a second wet end additive comprising a non-ionic surfactant; and wherein the ratio by weight of the first wet end additive to the second wet end additive in the tissue is between one to eight and one to ninety.

2. The structured tissue product according to claim 1, wherein the structured tissue product has an average peak to valley depth of at least 100 microns.

3. The structured tissue product according to claim 1, wherein the first exterior layer comprises at least 50% virgin hardwood fibers.

4. The structured tissue product according to claim 1, wherein the first exterior layer comprises at least 75% virgin hardwood fibers.

5. The structured tissue product according to claim 3, wherein the virgin hardwood fibers is virgin eucalyptus fibers.

6. The structured tissue product according to claim 1, wherein the interior layer comprises cannabis fibers in an amount of 1% to 10%.

7. The structured tissue product according to claim 1, wherein the second exterior layer comprises cannabis fibers in an amount of 1% to 10%.

8. The structured tissue product according to claim 1, wherein the first exterior layer comprises a wet end temporary wet strength additive.

9. The structured tissue product according to claim 8, wherein the wet end temporary wet strength additive comprises glyoxalated polyacrylamide.

10. The structured tissue product according to claim 1, wherein the first exterior layer comprises a wet end dry strength additive.

11. The structured tissue product according to claim 10, wherein the wet end dry strength additive comprises amphoteric starch.

12. The structured tissue product according to claim 1, wherein the second exterior layer comprises a wet end dry strength additive.

13. The structured tissue product according to claim 12, wherein the wet end dry strength additive comprises amphoteric starch.

14. The structured tissue product according to claim 1, wherein the second wet end additive comprises an ethoxylated vegetable oil.

15. The structured tissue product according to claim 1, wherein the second wet end additive comprises a combination of ethoxylated vegetable oils.

16. The structured tissue product according to claim 1, wherein the ionic surfactant comprises a debonder.

17. The structured tissue product according to claim 1, wherein the first and second exterior layers are substantially free of surface deposited softener agents or lotions.

18. The structured tissue product according to claim 1, wherein the first exterior layer comprises a surface deposited softener agent or lotion.

19. The structured tissue product according to claim 1, wherein the non-ionic surfactant has a hydrophilic-lipophilic balance of less than 10.

20. The structured tissue product of claim 1, wherein the tissue product has a caliper of 450 microns/2 ply to 600 microns/2 ply and is un-calendered.

21. The structured tissue product of claim 1, wherein the tissue product has a caliper of 600 microns/2 ply to 800 microns/2 ply and is uncalendered.

22. The structured tissue product of claim 1, wherein the tissue product has a caliper of 500 microns/2 ply to 700 microns/2 ply and is calendered.

23. The structured tissue product of claim 1, wherein the tissue product has a basis weight in g/m2 per 2 ply of 28 g/m2 to 39 g/m2.

24. The structured tissue product of claim 1, wherein the tissue product has a machine direction tensile strength per 2 ply of 110 N/m to 190 N/m.

25. The structured tissue product of claim 1, wherein the tissue product has a cross machine direction tensile strength per 2 ply of 35 N/m to 90 N/m.

26. The structured tissue product of claim 1, wherein the tissue product has a machine direction stretch of 4% to 30% per 2 ply.

27. The structured tissue product of claim 1, wherein the tissue product has a cross direction stretch of 4% to 20% per 2 ply.

28. The structured tissue product of claim 1, wherein the tissue product has a 2-ply cross direction wet tensile strength of 0 to 25 N/m.

29. The structured tissue product of claim 1, wherein the tissue product has a ball burst strength of 150 gf to 300 gf per 2-ply.

30. The structured tissue product of claim 1, wherein the tissue product has a lint value of 2.5 to 7.5 per 2 ply.

31. The structured tissue product of claim 1, wherein the tissue product has a softness of 85 TSA to 100 TSA.

32. The structured tissue product of claim 1, wherein the bulk softness (TS7) of the tissue product is 10 or less.

33. The structured tissue product of claim 1, wherein the tissue product has no wet end additives.

34. The structured tissue product of claim 1, wherein a web that makes up at least one of the two plies contains a glyoxylated polyacrylamide, an amphoteric starch and a debonder.

35. The structured tissue product of claim 1, wherein the first exterior layer is comprised of 100% eucalyptus fibers.

36. The structured tissue product of claim 1, wherein the interior layer contains 10% cannabis fibers, 30% northern bleached softwood kraft fibers and 60% eucalyptus fibers.

37. The structured tissue product of claim 1, wherein the second exterior layer contains 10% cannabis fibers, 20% northern bleached softwood kraft fibers and 70% eucalyptus fibers.

38. The structured tissue product of claim 1, wherein a web that makes up at least one of the at least two plies is creped at 15% crepe.

* * * * *